US005442826A

United States Patent [19]

Murata et al.

[11] Patent Number: 5,442,826

[45] Date of Patent: Aug. 22, 1995

[54] APPARATUS FOR CLEANING THE INSIDE OF A PIPE

[75] Inventors: Kazue Murata; Hiroshi Tada; Yoshitaka Koishi, all of Hirakata; Osamu Matsui, Osaka; Kiyoshi Morimoto, Mishima; Yoshika Sanada, Shizuoka; Teiichi Miwa, Mishima, all of Japan

[73] Assignees: Matsui Manufacturing Co., Ltd., Osaka; Kyowa Hakko Kogyo Co., Ltd., Tokyo, both of Japan

[21] Appl. No.: 88,199

[22] Filed: Jul. 6, 1993

[30] Foreign Application Priority Data

Jul. 24, 1992 [JP] Japan ..... 4-239951

[51] Int. Cl.[6] ..... B08B 9/02

[52] U.S. Cl. ..... 15/3.51; 15/104.062

[58] Field of Search ..... 15/3.5, 3.51, 104.062, 15/104.05, 104.061, 104.07; 134/22.11, 22.12; 165/95

[56] References Cited

U.S. PATENT DOCUMENTS

| | | | |
|---|---|---|---|
| 2,087,414 | 7/1937 | Schaer | 15/3.51 |
| 3,278,961 | 10/1966 | Svensson | 15/3.51 |
| 4,846,259 | 7/1989 | Fujimoto et al. | 15/3.51 |
| 5,221,047 | 6/1993 | Akeel | 15/3.51 |

FOREIGN PATENT DOCUMENTS

| | | | |
|---|---|---|---|
| 2241450 | 3/1973 | Germany | 15/3.51 |

*Primary Examiner*—Edward L. Roberts, Jr.
*Attorney, Agent, or Firm*—Koda & Androlia

[57] ABSTRACT

The invention disclosed a method for cleaning a pipe in the inside comprising steps of inserting a pig into a pipe, and reciprocally moving the pig thereafter by aerial vibration to clean the inside of pipe. An apparatus for cleaning a pipe in the inside comprises a pig removably inserted into a pipe from an end side thereof and a vibration generating source for transferring the pig in reciprocal motion by means of aerial motion to clean the inside of pipe.

32 Claims, 17 Drawing Sheets

APPARATUS FOR CLEANING THE INSIDE OF A PIPE

BACKGROUND OF THE INVENTION

1. Field of the Invention

The present invention relates to a method and apparatus for cleaning the inside of a pipe used in pneumatic transportation systems, dryers, dehumidifiers and many other fields, in particular, cleaning in place.

2. Prior Art

Conventionally, such method of inserting a brush with a brush body attached to a leading end of elongated member such as a wire, and cleaning inside of a pipe by manually sliding the brush with supply water is widely known as a method for cleaning the inside of a pipe.

In the case of cleaning the inside of a pipe by the conventional brushing method, particularly when multiple short pipes are connected by means of such detachable mechanism as flange joint, short pipes (pipes) required for cleaning have been removed by releasing the detachable mechanism, transported to a cleaning station, then, manually cleaned in the inside thereof by the brush prepared separately, and reassembled again as they were, after they have been dried.

Thus, the conventional brushing method has the following problems:

1. In either case that a pipe comprises a single pipe or a combination of two or more short pipes, because the inside or pipe is cleaned manually by sliding a brush, not only the cleaning operation has been laborsome and time-consuming, but also it has been different to uniformly clean the inside of the pipe (short pipe), and cleaning effect has been insufficient. In addition, there has been such problem that the pipe must be transported to a pipe cleaning station, and the transporting operation is troublesome.

2. Specifically, in the case of a pipe comprising a combination of two or more short pipes, since operations of disassembling, cleaning, drying and assembling pipes to be cleaned must be performed totally manually, the cleaning operation has been troublesome and time-consuming.

3. Because many of pipes (short pipes) to be cleaned are mounted in a high location, the disassembling and assembling operations have been risky.

4. As pipes are cleaned by using water as well as a brush, a dryer for removing the water is required, and there has been a problem of high equipment cost.

5. When cleaning the pipe in the assembled state without disassembling, it was difficult to remove the remainder of transportation protective materials clogged in the pipe joints or moisture.

SUMMARY OF THE INVENTION (1) It is one of the objects of the invention to present a method of cleaning the inside of a pipe, in which, because the pig is reciprocally moved by aerial vibration to clean the inside of a pipe after it is inserted from an end of the pipe, the inside of pipe assembled into a pneumatic transportation system or the like can be automatically cleaned in the assembled state without being disassembled, labor and time required for cleaning operation can be reduced, in comparison with prior art, cleaning effect is increased, because the cleaning can be performed uniformly and efficiently, an safety in the cleaning operation is ensured, as operations at a high level is eliminated.

(2) It is other object of the invention to present a method of cleaning the inside of a pipe, which comprises the wetting or solution cleaning step, pig inserting step and pig cleaning step, and therefore since the inside of the pipe is cleaned by transferring the pig in reciprocal motion by aerial vibration, the same effects as that of (1) above are provided.

In such case, by providing the wetting step, deposits adhered to the inside wall of pipe are loosened, and can be more easily cleaned in the succeeding step. In this operation, the deposits are removed even more efficiently by bubbling the cleaning solution supplied by aerodynamic force of the air source.

(3) According to a different object of the invention to present a method of cleaning the inside of a pipe, in the wet cleaning methods, as the pig contracting step for contracting the pig is added, when water is absorbed by the pig in the pig cleaning and other steps, the water contained in the pig can be removed.

Also, in this case, since the rinsing step is added after the pig cleaning step, deposits remaining in the pipe can be discharged out of the system. In the rinsing step, the deposits within the pipeline can be even more effectively discharged by bubbling the cleaning solution supplied by aerodynamic force from the air source.

Moreover, in such case, the inside wall of pipe that is wet-cleaned can be effectively dried, because the water droplet removing step is performed after completion of the rinsing step, that is, the dewatered pig is inserted into the pipe, and reciprocally moved in the pipeline by means of aerial vibration, thus, water droplets adhered to the inside wall of pipe is absorbed and removed by the pig.

(4) In another object of the invention, the methods of the invention assures complete drying of the inside wall of pipe, regardless of dry or wet method, as the drying step for drying the inside of pipe is provided.

In such case, not only the inside wall can be dried approximately at an ordinary temperature without an exclusive heater, but saving of thermal energy is achieved by utilizing air flow from the air source that constitute the vibration generating source for generating that aerial vibration wave in the drying step.

(5) It is a further different object of the invention to present an apparatus for cleaning the inside of a pipe so that the methods of the invention can be effectively conducted.

In other words, the apparatuses of the invention are provided with a vibration generating source for aerial vibration to achieve the pig cleaning step, wetting means for achieving the wetting step, pig contracting means for carrying out the pig contracting step, solution cleaning means for effecting the solution cleaning step, rinsing means for performing the rinsing step, water droplet removing means for carrying out the water droplet removing step and drying means for achieving the drying step.

In particular, the pig in the pipe to be cleaned is moved reciprocally by air vibration, and therefore the inside of the piping is cleaned by sliding the pig, and at the same time the vaporization action is activated by the air vibration to obtain a drying effect. Furthermore, the remaining transportation protective materials, dust, moisture, and water drops clogged in the piping joints can be sucked out and removed by the supplied air vibration, so that cleaning and drying of all piping parts can be achieved at the same time.

Moreover, air inlet and outlet are provided in the vibration source, and the pig can be transferred while moving reciprocally, and therefore the entire pipe can be cleaned by reciprocating the pig in small strokes, so that it is easy to handle because large strokes over the entire length of pipe are not needed. Still more, by moving to a desired position, that position can be cleaned particularly, and arbitrary cleaning is realized.

(6) Moreover, in a different object of the invention is present an apparatus for cleaning the inside of a pipe, because a position sensor is provided corresponding to points in the pipe where dirts tend to be accumulated, and a signal transmitted from the position sensor is received by a controller so that the number of reciprocal movements of the pig and waveform of aerial vibration can be adjusted in the vicinity of the position sensor on the basis of the signal received by the controller, the points in the pipe where dirts tend to be accumulated can be cleaned thoroughly, and uniform cleaning effect can be obtained.

(7) Furthermore, in a still different object of the invention to present an apparatus for cleaning the inside of a pipe, since the pig forms a spiral slit groove in the outer surface thereof in the longitudinal direction of a columnar body, and rotated by passing air from the air source through the slit groove, the inside wall of the pipe can be cleaned by the pig in rotation, and the entire circumference of the inside wall of pipe is thoroughly cleaned, thereby, the cleaning effect is further increased.

Incidentally, when the pipe is composed as in the present invention, the water sealing effect of the joint part of the pipe is excellent, and if there is water leak between the sleeve and the tubular joint, the water leak can be sucked into the conduit by the air vibration waves.

Other objects, features and benefits of the invention will be better understood and appreciated in the following description.

In order to achieve the objects, the invention presents a method for cleaning a pipe, by rendering reciprocal motion of a pig by means of aerial vibration after inserting the pig into the pipe to clean the inside thereof. In other words, the embodiment of the invention is a dry cleaning method comprising steps of inserting a pig into a pipe, and cleaning the inside thereof by rendering reciprocal motion of the pig by means of aerial vibration.

In the method of the invention the wet cleaning method comprises a wetting step for moistening inside of the pipe, a pig insertion step for inserting the pig into the pipe, and a pig cleaning step for cleaning the inside of a pipe by transferring the pig while moving reciprocally by air vibration. In this wet cleaning method, when the pig absorbs moisture, a pig squeezing step is provided for squeezing the pig in order to remove moisture from the pig.

A method according to the invention is a solution cleaning method comprising steps of cleaning inside of a pipe with a cleaning solution, inserting a pig into the pipe, and cleaning the inside thereof by transferring the pig in reciprocal motion by means of aerial vibration. In the case of the solution cleaning method, a pig contracting step is added, when the pig contains water absorbed in it, to remove moisture from the pig.

When the pig cleaning step is performed, it is preferable to conduct a rinsing step after completion of the pig cleaning step. It is preferred to conduct a water droplet removing step for removing water droplets in the pipe after completion of the rinsing step.

A method according to the invention is provided with a drying step for drying inside of a pipe in the method of the invention.

As described above, the invention presents such methods of dry cleaning the inside of a pipe by using a pig, wet cleaning by the pig, cleaning by the pipe after cleaning with a solution, rinsing after cleaning by the pig, and removing water droplets adhered to inside wall of the pipe, or an appropriate combination of them, for example, by adding a drying step thereto.

In addition, for example, wetting, pig inserting, pig cleaning for cleaning with the pig while feeding cleaning solution, pig contracting, rinsing, water droplet removing and drying steps can be performed. In this case, in the wetting and rinsing steps, it is preferable that a cleaning solution supplied is bubbled by means of aerodynamic force from an air source. Moreover, in the drying step, air flow from the air source that constitutes a source for generating the vibratory wave of air used for pig cleaning are preferably utilized, thereby eliminating an exclusive heater, allowing efficient drying at ordinary temperature, and contributing reduction of energy consumption.

The cleaning apparatus according to the present invention, relates to an apparatus for cleaning the inside of a pipe for conducting the methods of the invention.

An apparatus of the invention comprises a pig removably inserted from an end of pipe and a vibration generating source for cleaning inside of the pipe by transferring the pig in reciprocal motion by means of aerial vibration. In this case, a dry cleaning apparatus is provided. Air inlet and outlet are provided in the vibration source, and the pig moving reciprocally in the pipe to be cleaned can be moved freely in the upstream direction or downstream direction by injection or suction of air from the air inlet and outlet, so that the pig may be transferred while moving reciprocally.

An apparatus of the invention is provided with wetting means such as water supply and drainage system for wetting inside of a pipe in addition to the pig and vibration generating source, and an apparatus of the invention is provided with pig contracting means. In such cases, a wet cleaning apparatus is provided.

An apparatus of the invention is provided with solution cleaning means for cleaning inside of a pipe with a cleaning solution in addition to the pig and vibration generating source, and an apparatus of the invention is provided with pig contracting means, additionally to the pig, vibration generating source and solution cleaning means, for contracting the pig. In such cases, an arrangement for cleaning with a pig after solution cleaning is provided.

The invention provides apparatuses having rinsing means. In such cases, it is preferable that the apparatus has water droplet removing means for removing water droplets adhered to inside wall of a pipe (including means for finely breaking such water droplets, as used in the present specification).

An apparatus of the invention is provided with drying means for drying inside of a pipe in an apparatus of the invention. As the drying means, it is preferred to dry the inner wall of the pipe by the air flow from the air source as the vibration source used in the pig cleaning.

By drying inside of a pipe in a final step of cleaning, a pipe ready for use in a succeeding step can be obtained.

An apparatus of the invention is provided with a position sensor corresponding to points in a pipe where dirts tend to be accumulated in an apparatus of the invention, and structured such that a signal transmitted by the position sensor is received by a controller, and the number of reciprocal motions of the pig and waveform of aerial vibration can be adjusted in the vicinity of the position sensor on the basis of the signal received by the controller. In such manner, points in a pipe where dirts tend to be accumulated can be thoroughly cleaned, and a uniform cleaning effect is obtained.

The invention presents an apparatus, wherein the pig forms a spiral slit groove in an outer surface in longitudinal direction of a columnar member, and are rotated by passing air from the air source in the slit groove. Consequently, the pipe can be more uniformly and evenly cleaned, and cleaning effect can be further enhanced. Although any material can be used for the pig, those having a superior chemical resistance and resiliency for not damaging a body to be cleaned, and being superior in hydrophilic property and wear resistance such as polyvinyl alcohol, pulp and urethane rubber (elastomer) are preferred.

According to a method of the invention, both in dry and wet type, the pig is inserted in the pipe to be cleaned and then air vibration is supplied into the pipe, and therefore the pig is moved reciprocally by the vibrating air, and at the same time the degree of air-liquid contact is enhanced in the pipe, and the vaporization of the liquid is activated. Thus, in the pipe, the pig moves reciprocally, and the cleaning of the inside of the pipe by its sliding action and drying by promotion of vaporization by vibration are progressed simultaneously. That is, when using air vibration, both effects of cleaning and drying are brought about at the same time. Therefore, separate dryer or conventional brush is not needed, and moreover by properly changing the waveform and frequency of aerial vibration, the pig reciprocal stroke and number of reciprocal motions can be adjusted, and an efficient cleaning depending on the dirtiness of the pipe is achieved.

In the case of wet cleaning method, since a wetting step for applying moisture in a pipe is provided, deposits adhered to the inside wall thereof can be thereby loosened, and cleaning in the succeeding step is further facilitated. In this case, it is preferable that a cleaning solution supplied is bubbled by aerodynamic force of an air source.

In addition, as a step for contracting the pig is provided, when water is absorbed in the pig during the pig cleaning step and the like, the water contained in the pig is removed.

Because of a rinsing step provided after completion of the pig cleaning step, deposits remaining in the pipe is washed out by the rinsing solution. In the rinsing step, it is preferable to bubble the solution supplied by aerodynamic force from an air source.

Since a water droplet removing step is provided after completion of the rinsing step, a pig without water content is inserted into the pipe and reciprocally moved by means of aerial vibration within the tubular path, and water droplets adhered to the inside wall of pipe are absorbed and removed by the pig.

As a drying step for drying inside of a pipe is provided in the method of the invention, regardless of dry or wet type, inside wall of a pipe is surely dried.

In this case, it is preferable to utilize the air stream from the air source as the vibration source used to pig cleaning in the drying step.

With an apparatus of the invention provided with pig, air inlet and outlet, vibration generating source, wetting means, pig contracting means, solution cleaning means, rinsing means, water droplet removing means and drying means, above method can be effectively performed.

In an apparatus of the invention, because a portion sensor is provided corresponding to points in a pipe where dirts tend to be accumulated, a signal transmitted by the position sensor is received by a controller, and the number of reciprocal motion of the pig and waveform of aerial vibration can be adjusted in the vicinity of the position sensor based on the signal received by the controller, such points in the pipe where dirts tend to be accumulated are thoroughly cleaned.

Moreover, in the apparatus of the invention, since the pig forms a spiral slit groove in an outer surface in the longitudinal direction of a columnar body, and rotated by passing air from an air source in the slit groove, the pig rotates and cleans inside wall of a pipe, the entire circumference of inside wall of the pipe can be cleaned, and cleaning effect is further increased.

DETAILED DESCRIPTION OF THE INVENTION

Referring now to FIGS. 1 to 7 showing an apparatus of the invention, embodiment 1 is described as well as a method of the invention.

Figure 1:
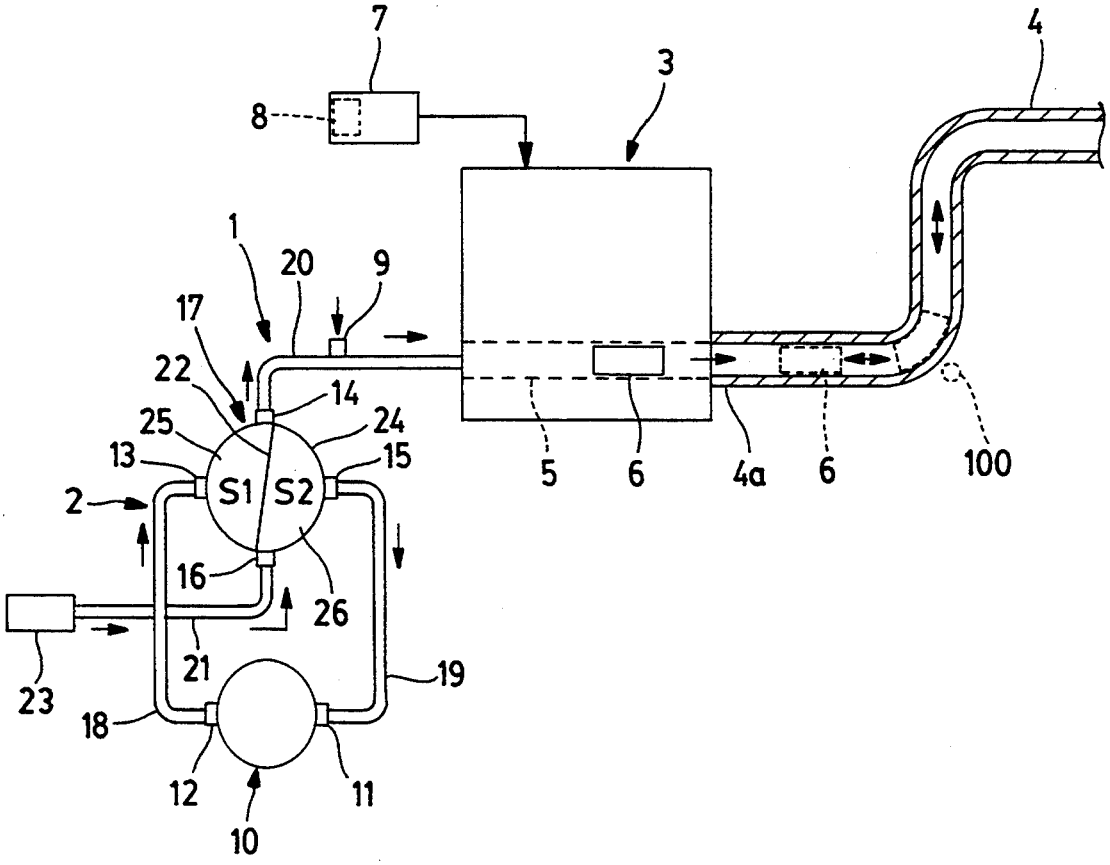
FIG. 1 is a schematic view showing a part of embodiment 1 of an apparatus of the invention in section.
Figure 4:
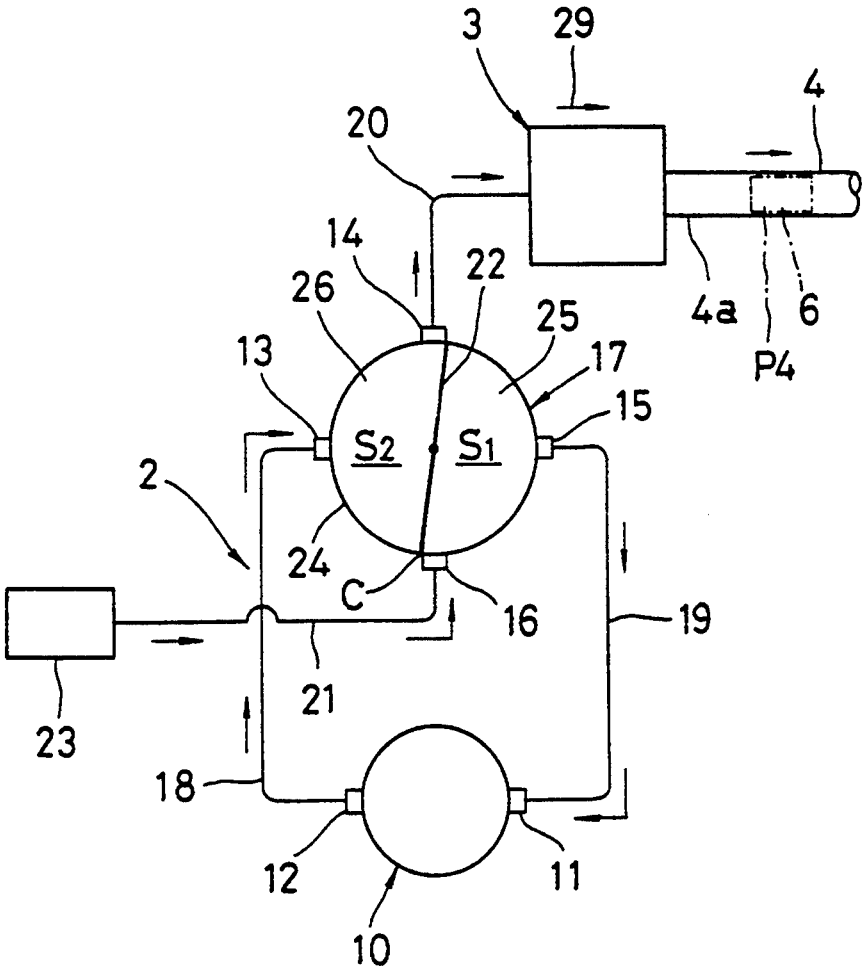
FIG. 4 is a process diagram with the valve member further rotated at a predetermined angle from FIG. 3.
Figure 5:
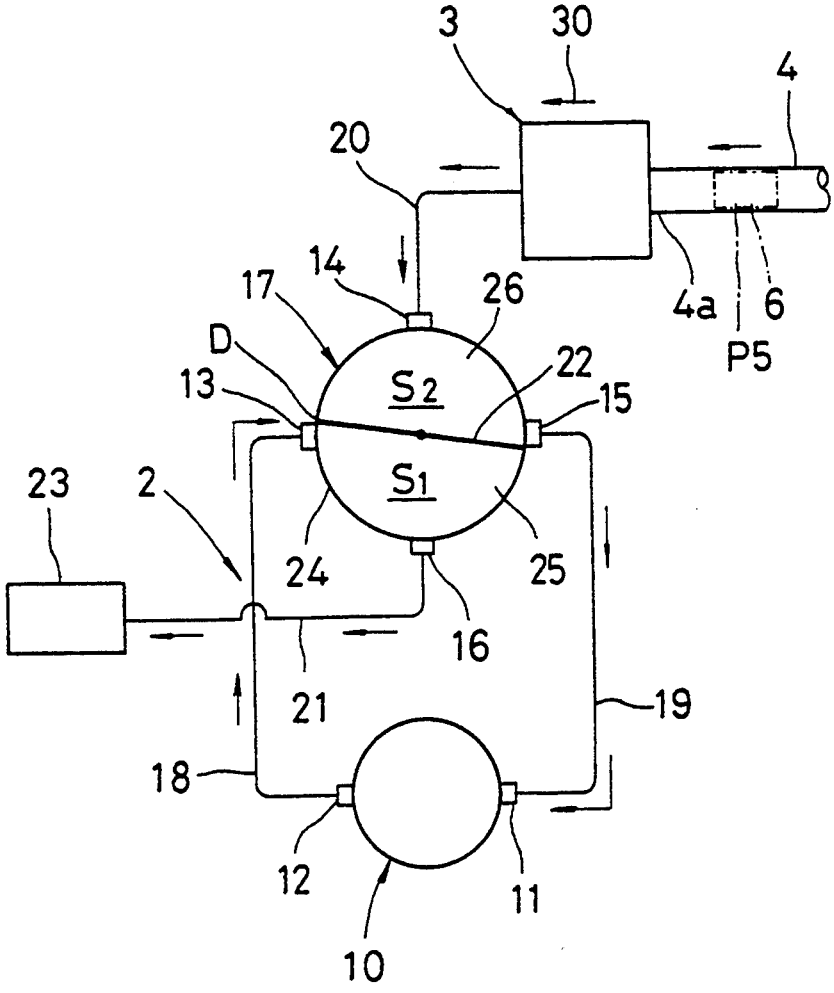
FIG. 5 is a process diagram with the valve member further rotated at a predetermined angle from FIG. 4.
Figure 6:
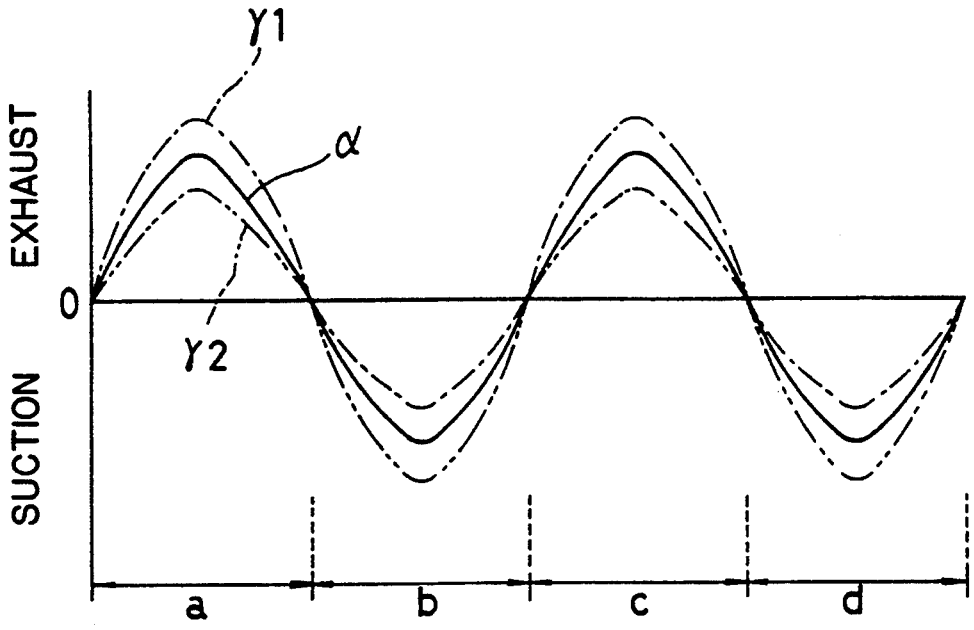
FIG. 6 is a waveform chart.
Figure 7:
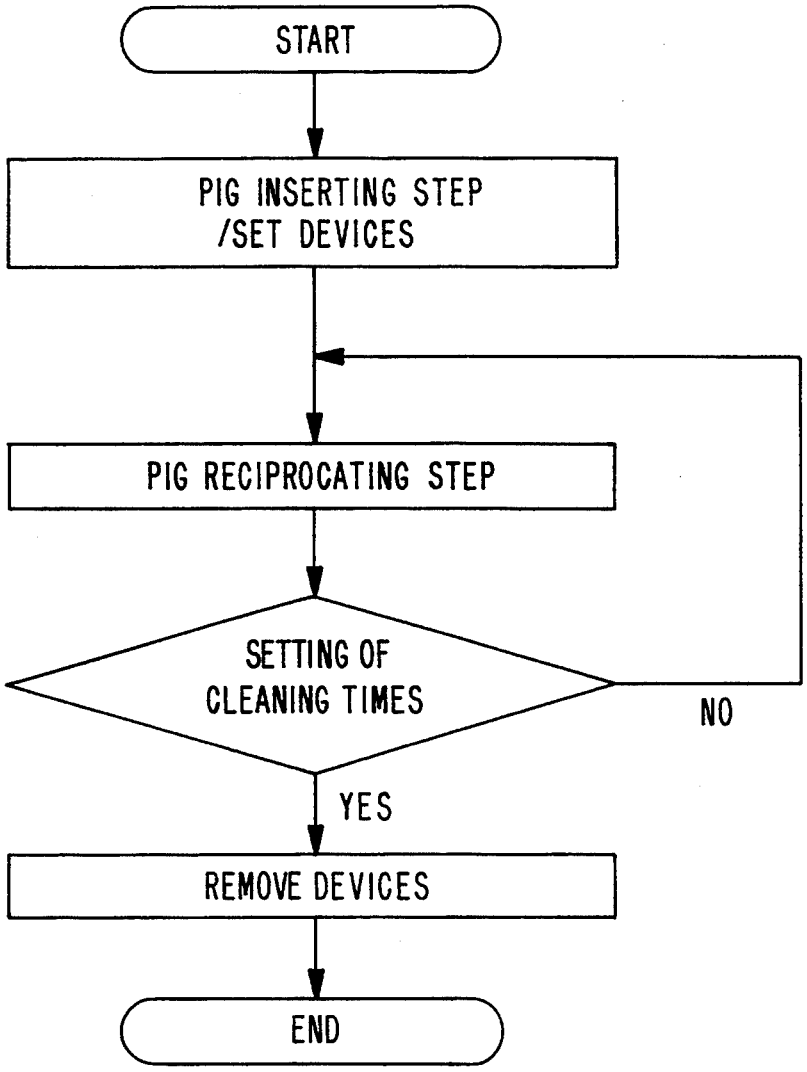
FIG. 7 is a flow chart of embodiment 1.

FIG. 1 is a schematic view showing a partial section of a dry cleaning apparatus 1 of the invention for cleaning the inside of a pipe, FIGS. 2 to 5 show an airflow vibrated and reciprocal motion of a pig, when a directional control valve 17 changes from 0 to 270 deg. in a vibration generating source 2. FIG. 6 is a waveform diagram showing changes of air flow vibrated by one rotation of the directional control valve 17 from FIG. 2 through FIGS. 3, 4 and 5 to the original position of FIG. 2. FIG. 7 shows a step diagram of the embodiment.

In FIG. 1, numeral 3 shows a main body of cleaning apparatus, a pig inserting tube 5 is employed in the main body 3 of the cleaning apparatus, and a pig 6 is removably inserted into the pig inserting tube 5 beforehand. The pig inserting tube 5 is connected to an end 4*a* of pipe 4 to be cleaned in one end, while the vibration generating source 2 in the other end. The end 4*a* of pipe 4 is air-tightly connected in communication with a conduit 20 of the vibration generating source 2 through the pig inserting tube 5. Insertion and removal of pig 6 in the main body 3 may alternatively achieved by arranging the pig inserting tube 5 in T shape or any other arrangement.

The vibration generating source 2 is provided for the purpose by means of aerial vibration to clean the inside of pipe 4. However, it is desirable that the vibration generating source 2 provides an aerial vibration (sound wave) of low or medium frequency.

The vibration generating source 2 comprises, as shown in FIGS. 1 to 5, an air source 10 with an inlet 11 and/or outlet 12, a directional control valve 17 having four or more ports 13, 14, 15, 16 . . . , a driving source (not shown) such as a motor for driving the directional control valve 17, a discharge pipe 18 and intake pipe 19 for respectively connecting the air source 10 and directional control valve 17, a conduit 20 for connecting the port 14 and the pig inserting tube 5, and a conduit 21 for connecting a filter 23 and the port 16.

In the leading end of conduit 20 in connection with the port 14, the main body 3 of cleaning apparatus is connected or the conduit 20 is provided with an air inlet-and-outlet 9. Where no inlet-and-outlet 9 is provided, a valve member 22 in the casing 24 of the directional control valve 17 is rotated against air supplied by the air source 10, and the position of the valve member 22 is changed with respect to each port 13, 14, 15 and 16 so as to change the directions of air. In this way, air vibration is obtained because of the action of a discharge air stream from the base to the leading end of the pipe 4 as indicated by the arrows in FIGS. 2 and 4, and an intake stream from the leading end to the base of the pipe 4 as indicated by the arrows in FIGS. 3 and 5. The amounts of the discharge air stream and the intake air stream are the same, which is demonstrated in FIG. 6 by the wave depicted by the full line in which the height of the hill portion and the depth of the valley portion are the same. In this situation, the slidable pig 6 is reciprocally moved in and along the pipe 4 under the action of the discharge air stream and the intake air stream but because of the same amounts of the streams the pig 6 moves to and fro only in the same range. In order to clean the inside of the pipe, the pig 6 must be caused to advance and retreat beyond the reciprocating range.

In order to solve the problem arising from the embodiment described above, an air inlet-and-outlet 9 is provided at the upstream of the vibration generating source 2. The inlet-and-outlet 9 can be provided either in the discharge pipe 18 or in the intake pipe 19 but an embodiment having it in the conduit 20 will be described:

When a discharge air flows through the conduit 20, the intake air through the inlet-and-outlet 9 increases the amount of the discharge air by the inlet amount. When an intake air flows, air is continuously introduced through the inlet-and-outlet 9 over the periods of discharge and intake, thereby causing a certain amount of intake air to remain unsucked because of over-supply. This is shown by a wave depicted in chain lines $\gamma 1$. As is evident from the graph, the height of the wave $\gamma 1$ is higher by the inlet amount than that of the wave $\alpha$. The valley of the wave $\gamma 1$ is shallower by the inlet amount than that of the wave $\alpha$. A difference between the absolute values of the sizes of the hill and valley is equal to the inlet amount of air introduced over the periods of discharge and intake. This state can be expressed in terms of the movement of the pig 6 as follows:

The pig 6 inserted at the base portion of the pipe 4 is advanced in a forward direction to a position determined by a total amount of discharge air and intake air, and is moved back to a position determined by an amount determined by subtracting the inlet supply from the intake amount. In this way, while the reciprocal movement of the pig 6 is repeated over a range determined by the amount of discharge and intake, the pig 6 is moved downstream and reaches the terminating end of the pipe 4.

When the inlet-and-outlet 9 is provided in each of the discharge pipe 18 and the intake pipe 19, the one in the discharge pipe 18 is used for a discharge flow, and the one in the intake pipe 19 is used for an intake flow. In this case, the moving speed of the pig 6 is reduced by one-half as compared with that achievable when the inlet-and-outlet 9 is provided in the conduit 20.

The withdrawal of air through the inlet-and-outlet 9 will be described:

The withdrawal of air causes the pig 6 to function reversely as mentioned above, an indicated by two-dotted line $\gamma 2$ in FIG. 6. This state of $\gamma 2$ will be explained by comparison with the wave $\alpha$. This wave has a hill portion whose height is lower by the amount of withdrawn air than that of the wave $\alpha$, and a valley portion whose depth is deeper by the amount of withdrawn air than that of the wave $\alpha$. This situation tells that the pig 6 reaching the terminating end of the pipe 4 is moved back toward the base portion up to a position determined by a total amount of the intake amount and the withdrawn amount, and that it is then moved forward toward the terminating end of the pipe 4 up to a position determined by an amount obtainable by subtracting the withdrawn amount from the discharge amount. While the reciprocal movement of the pig 6 is repeated over a range determined by the amount of discharge and intake, the pig 6 is moved toward the base portion of the pipe 4 over a distance determined by the withdrawn amount and finally reaches the base portion. In this way the cleaning of the inside of the conduit is finished. The use of the inlet-and-outlet 9 is advantageous in that the pig 6 can reciprocally move forward and backward under the withdrawal and intake of air through the inlet-and-outlet 9, which means that the inside of the conduit is cleaned twice by the double stroke which consists of the forward and backward movement of the pig 6. Where necessary, either of the stroke can be omitted by stopping the rotation of the valve 22 so as to use either the withdrawal or the intake of air through the inlet-and-outlet 9.

The movement of the pig 6 can be changed by changing the frequencies of switching from the discharge stream to the intake stream and vice versa. The frequency of air stream can be changed by changing the rotation (r.p.m.) of the valve 22. The rotation of the valve 22 can be changed by changing the rotation of the motor by means of the inverter 8. The increased rotation of the motor increases the frequency of switching, thereby reducing the frequency of reciprocal movement of the pig 6 per unit time. In FIG. 6, the wavelengths represented by a, b, c, d . . . on the X axis become short, that is, intervals a, b, c, d . . . are shortened.

In terms of the movement of the pig 6, the inside of the conduit is rubbed by the pig 6 more frequently per unit time than the otherwise case, which means that the inside of the conduit is efficiently cleaned. If dirtiness in the inside of the conduit is not very worse, the rubbing frequency may be reduced. The rotation of the motor can be reduced not only by the inverter 8 but also by a speed reduction device such as gears disposed between the motor and the valve 22.

In this embodiment, the vibration generating source 2 is adapted to be capable of providing a sound wave of low or medium frequency band as an aerial vibration and changing the waveform of a pulse wave, sine wave and the like. Waveform of the aerial vibration is changed in accordance to the vibration frequency or frequency, amplitude, and the like. As a method of changing the waveform of aerial vibration, the rotating speed of valve member 22 of the directional control valve 17, mounting angle of the valve member 22 in valve chests 25, 26, angle of rotation of the valve member 22, sectional open area of at least one or more ports in the directional control valve 17 or sectional shape of the casing 24, or mounting angle of the ports in the directional control valve 17 may be changed, or other various methods may be adopted.

According to an experimental example, the stroke of reciprocal motion of the pig 6 is increased by reducing the frequency of vibration generating source 2, while the stroke of reciprocal motion of the pig 6 is reduced by increasing the frequency. For example, the former was effected at a frequency of 1 Hz, and the latter at 8 Hz. The figures are not limiting.

Thus, according to a method of the invention shown in claim 1, the pig 6 is firstly inserted into the pipe 4. For inserting the pig 6 into the pipe 4, as described above, the main body 3 of cleaning apparatus with the pig 6 pre-inserted into the pig inserting tube 5 may be connected with the pipe 4 so that the pig can be transferred by means of aerial vibration from the vibration generating source 2, the pipe 4 may be connected with the main body 3 after the pig 6 is inserted manually to the inlet side of pipe 4, or other methods may be employed. The air vibrates under vibration provided by the vibration generating source 2, thereby causing the pig 6 to move to and fro in the conduit. While it moves to and fro, it rubs the inside of the pipe 4.

For the air source 10, such as ring blower, Roots blower may be selected arbitrarily, as far as it has both of inlet 11 and outlet 12.

For the directional control valve 17, although a rotary valve comprising a columnar casing 24 with four or more ports 13, 14, 15, 16 . . . and a valve member 22 of moving vane type housing in the casing 24 for rotation by a driving source and sectioning it into two valve chests 25, 26 is preferable, other type of valve such as ball valve may be used.

The two valve chests 25, 26 sectioned by the valve member 22 may be identical in their respective total passage volumes S1, S2 as shown in the embodiment, in such case, the waveform of aerial vibration shows a simple waveform as sine curve $\alpha$, shown in FIG. 6, as far as conditions such as rotating speed of the directional control valve 17 are same. In other words, the waveform is identical in frequency, amplitude and cyclic period.

When the valve chests are formed in such manner that the total passage volumes S1, S2 comes to be different, by changing the cycle of inlet and outlet by means of the directional control valve 17, and changing the frequency, amplitude and cyclic period of aerial vibration as desired, as shown by $\gamma$, the waveform can be arbitrarily changed from $\alpha$. As described above, the change of waveforms in air vibration is effected by changing the rotation (r.p.m.) of the motor by means of the inverter 8 which changes the frequency, so as to change the rotation (r.p.m.) of the valve 22 connected to the motor. As already described, other various methods may be employed alternatively to the one above.

Succeedingly, principle and operation of generating the aerial vibration (sound wave) by the vibration generating source 2 shown in the embodiment is described below while referring to FIGS. 2 to 6 in FIGS. 2 to 5, the controller 7, the inverter 8 and the inlet-and-outlet 9 are omitted.

1. Air intake and exhaust is initiated by driving the air source 10. It is assumed that the valve member 22 of directional control valve 17 is located in position A of FIG. 2 and the pig 6 stops at the position P1 at time 0. The airflow at the time is directed through the discharge pipe 18, valve chest 25, conduit 20 and main body 3 of the cleaning apparatus as shown by arrows. In the main body 3, the air flows from left to right as shown by an arrow 27 in FIG. 2, and a waveform shown in a section a of solid line $\alpha$ in FIG. 6, for example, is observed during a period a from time 0 at this stage, the pig 6 is advanced from the position P1 to the position P2.

2. Subsequently, at time 1, the valve member 22 of directional control valve 17 is driven to position B of FIG. 3 by the driving source. At this time, the air passes from the discharge pipe 18 through the valve chest 26 and conduit 21 to filter 23, while air in the inlet 11 of air source 10 is aspirated from the main body 3 of cleaning apparatus through the intake pipe 19, port 15, valve chest 25 and conduit 20, and returned to the air source 10. In the main body 3, the air flows from right to left, as shown by an arrow 28 in FIG. 3, and a waveform shown in a section b of solid line $\alpha$, for example, is observed during a period b from time 1 at this stage, the pig 6 is moved back from the position P2 (FIG. 2) up to the position P3 (FIG. 3).

Figure 2:
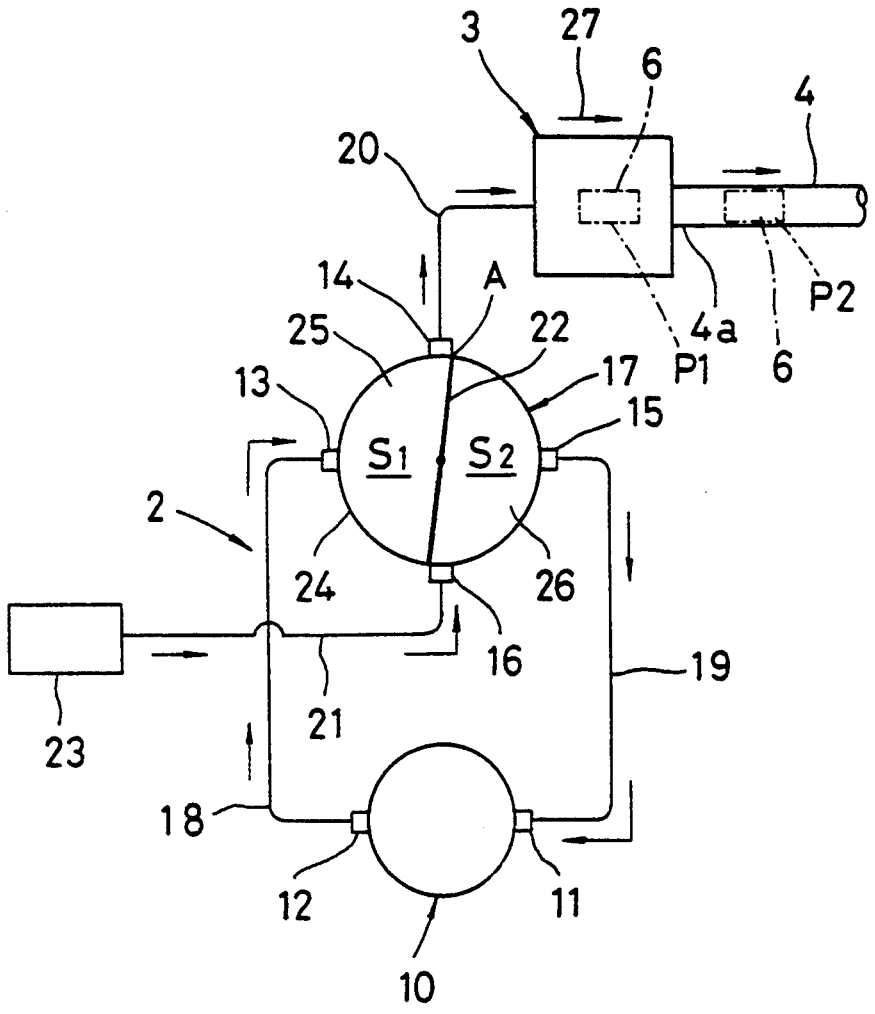
FIG. 2 is a schematic process diagram showing operation of a vibration generating source.
Figure 3:
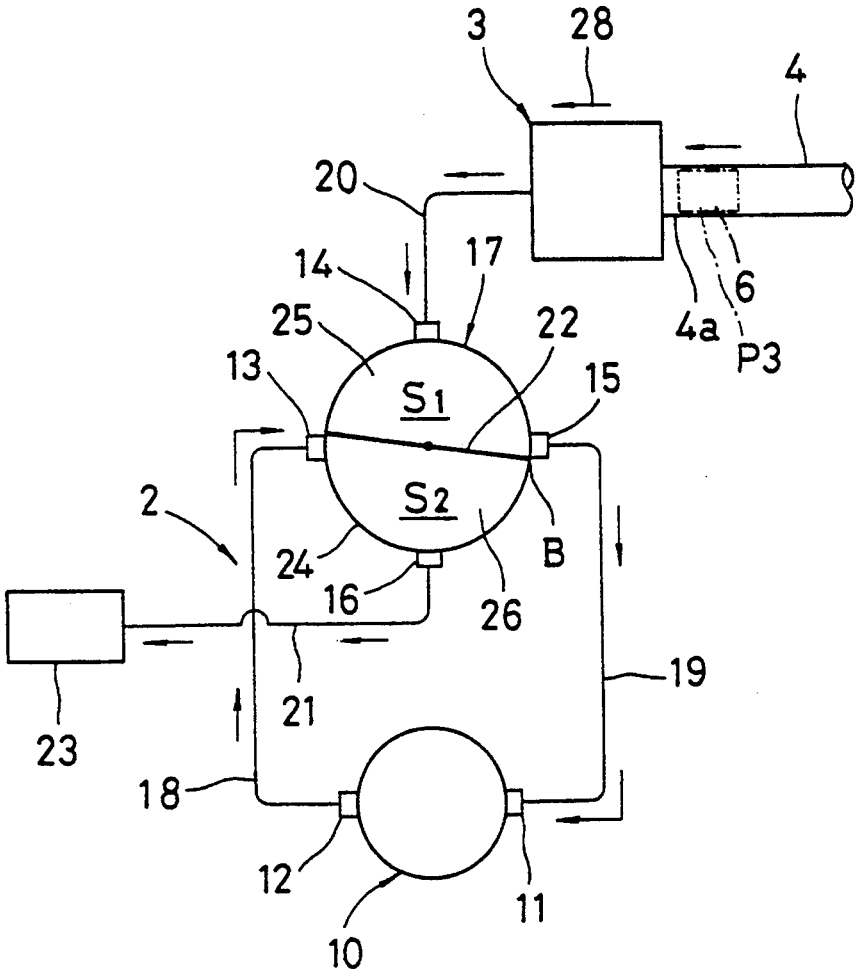
FIG. 3 is a process diagram with a valve member rotated at a predetermined angle from FIG. 2.

However, as a whole the pig 6 is advanced by a distance determined by (P3−P1) as compared with the P1 (FIG. 2).

3. Then, at time 2, the valve member 22 of the directional control valve 17 is driven to position C of FIG. 4 by the driving source. The airflow at this time is directed from the discharge pipe 18 through the valve chest 26 and conduit 20 to the main body 3 in the same manner as in FIG. 2. In the main body 3 of cleaning apparatus, similarly to the case of FIG. 2, the air flows from left to right as indicated by an arrow 29 in FIG. 4, and a waveform shown in section c of solid line $\alpha$ in FIG. 6, for example, is observed during a period c from time 2 at this stage, the pig 6 is advanced from the position P3 (FIG. 3) up to the position P4 (FIG. 4).

4. Succeedingly, at time 3, the valve member 22 of the directional control valve 17 is driven to position D of FIG. 5 by the driving source. The airflow at this time is directed, similarly to the case of FIG. 3, through the discharge pipe 18, valve chest 25, conduit 21 and filter 23, while the air from the air intake 11 of the air source 10 is aspirated as indicated by arrow from the main body 3 of cleaning apparatus through the intake pipe 19, port 15, valve chest 26 and conduit 20, and returned to the air source 10. In the main body 3, the air flows from right to left as shown by an arrow 30 in FIG. 5 in the same manner as in FIG. 3, and a waveform shown in section d of solid line $\alpha$ in FIG. 6, for example, is observed during period d from time 3 at this stage, the pig 6 is moved back from the position P4 (FIG. 4) up to the position P5 (FIG. 5).

However, as a whole the pig 6 is advanced by a distance determined by (P5−P3) as compared with the P3 (FIG. 3).

5. Furthermore, the valve member 22 of the directional control valve 17 is rotated from position D of FIG. 5 to position A of FIG. 2 by the driving source, the air is directed as described in 1, and the airflow in the main body 3 is in the same direction as that of the arrow 27 of FIG. 2. At this stage the pig 6 is advanced from the position P5 (FIG. 5) (not shown). Herein, as shown in FIGS. 2 to 5, when the valve member 22 of directional control valve 17 is rotated once, the waveform of aerial vibration is repeated in two cycles (FIG. 6) as described above, air vibration includes positive (plus) waves in the advancing direction and negative (minus) waves in the backward direction, and when they have the same amplitude as indicated by the waveform a in FIG. 6, the pig 6 moves to and fro within a fixed range and does not go beyond it.

Such motion is sequentially repeated in the time course, and the waveforms of aerial vibration from a continuous wave of simple sine waves as shown by solid line $\alpha$ in FIG. 6.

The waveform of aerial vibration can be changed in accordance with the vibration frequency or frequency, amplitude, continuous wave or pulse wave, and the like. As described above, the amplitude of air vibration can be changed from the waveform $\alpha$ to the waveform $\gamma$ in FIG. 6 by either changing the rotation (r.p.m.) of the valve 22 or to the waveform $\beta$ by changing the frequency by means of the inverter 8 or by introducing pressurized air into the inlet-and-outlet 9.

An example of cleaning process by a dry cleaning apparatus for pipes shown in the embodiment 1 is described by referring to FIG. 7.

First, the pig 6 is inserted in the tube 5 of the main body 3. After other necessary preparation is made, the start button is pressed. Then, a desired frequency of cleaning is set, and the vibration generating source 2 is operated so as to enable the pig 6 to move reciprocally under air vibration within the pipe 4 during which it rubs the inside thereof. It moves to and fro times as previously set. In this way the pig 6 advances to the terminating end of the pipe 4. More specifically, before the cleaning operation is started, the pig 6 is present at the position P1 (FIG. 2). When the operation is started, the pig 6 moves to the position P2 under the discharge air (plus wave for explanation convenience) of air vibration, The pig 6 moves from the position P2 to the position P3 (FIG. 3) under intake air stream (minus wave for explanation convenience). Then the pig 6 moves to the position P4 (FIG. 4). From the position P4 the pig 6 moves to the position P5 (FIG. 5). In this way, during the reciprocal movement the pig 6 cleans the inside of the pipe 4. It is turned out that the pig 6 moves from the P1 to the P5. When the pig 6 is required to move forward and backward beyond the above-mentioned range, it is preferred that the inlet-and-outlet 9 is provided in the conduit 20 so as to introduce air or withdraw it therethrough. The cleaning operation finishes with the removal of each component. It is possible to adjust the moving distance of the pig 6 as desired.

An embodiment 2 of an apparatus of the invention is a best mode of the invention described below on the basis of FIGS. 8 to 14. This embodiment illustrates a wet type cleaning apparatus.

In other words, in an apparatus 1 for cleaning inside of a pipe of the embodiment 2, as shown in the previous embodiment, a main body 3 of the cleaning apparatus is connected with an end side 4*a* of pipe 4 to be cleaned in one end, and a vibration generating source 2 comprising an air source 10, directional control valve 17 and the like and wetting means 40 in the other. In the main body 3, a conduit 20*a* air-tightly connected with the end 4*a* of pipe 4 and the conduit 20 of vibration generating source 2 and a pig inserting tube 5 are provided, the pig inserting tube is provided with pig contracting means 110, and the pig 6 is removably inserted beforehand. The vibration generating source 2 of the embodiment comprises the air source 10 such as a ring blower and the like, the directional control valve 17 with four ports, a driving source 31 for driving the directional control valve 17, a discharge pipe 18 connecting the air source 10 and the directional control valve 17, an intake pipe 19, a conduit 20 connecting a port of the directional control valve 17 and the pig inserting tube 5, an air inlet and outlet pipe 32 sharing the conduit 20 and introducing the outside air controller 33 controlling both the air source 10 and the driving source 31.

Numeral 34 is a filter, 35 a valve, 36 a collection filter, and 37 a collection tank.

Figure 8:
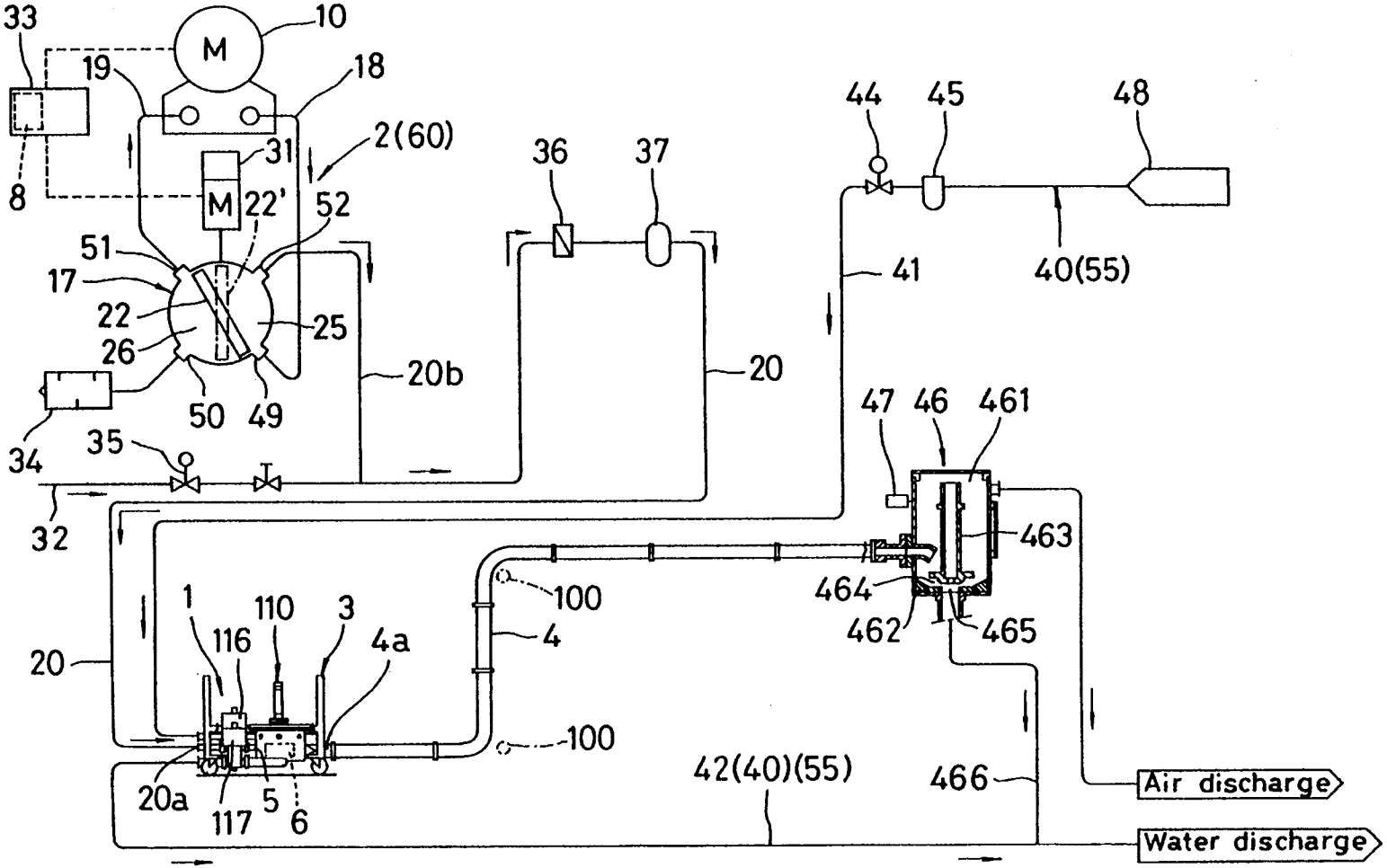
FIG. 8 is a schematic view of embodiment 2 of an apparatus of the invention with a valve member at an original position.
Figure 9:
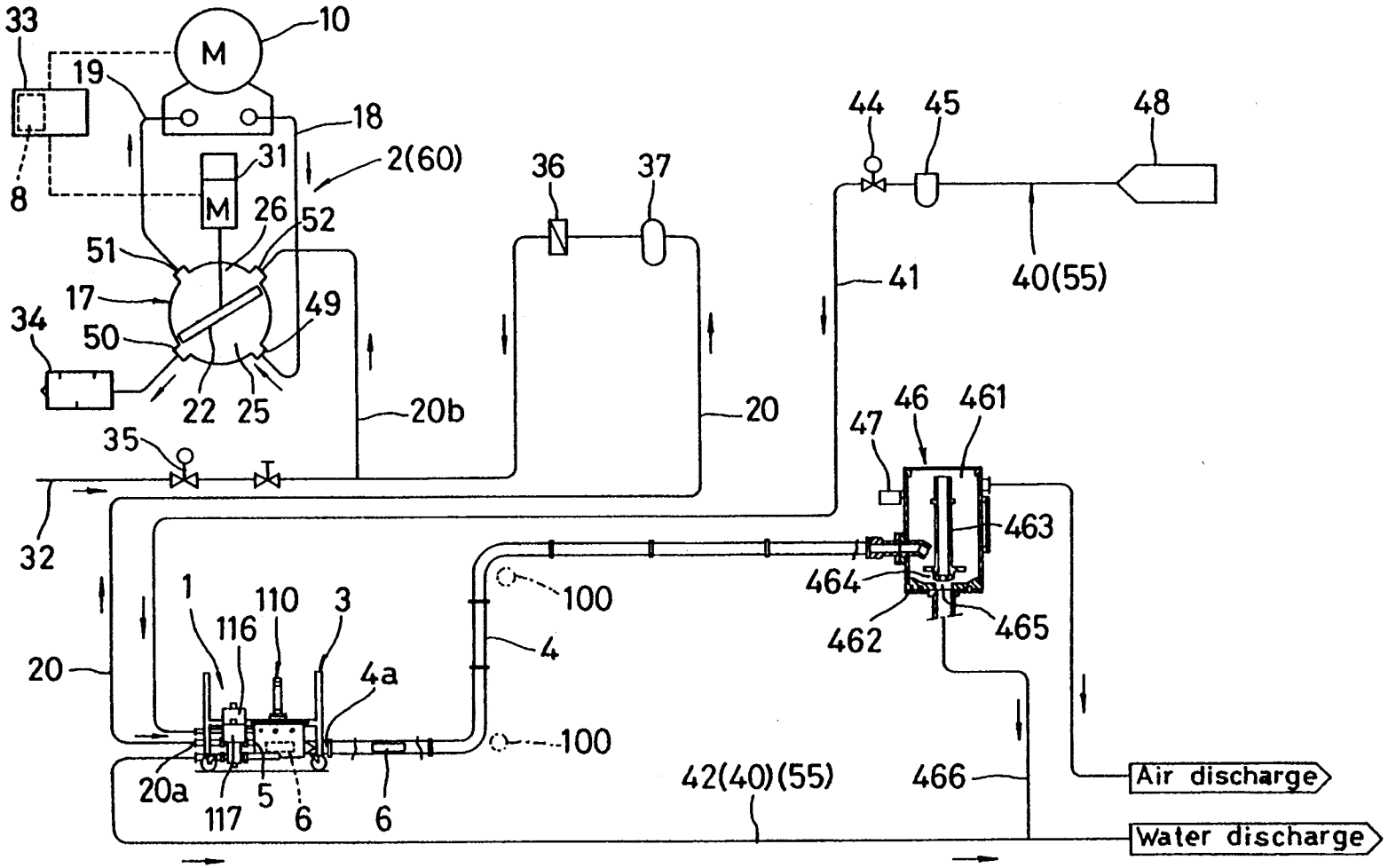
FIG. 9 is a schematic view with the valve member rotated at a certain angle from the original position of FIG. 8.

Although the wetting means 40 may have any structure, in this embodiment, it is structured so as to supply and discharge such cleaning solution as clean pipe water and distilled water. In other words, the wetting means 40 comprises a solution supply source 48, a feed pipe 41 connected with a solution supply source 48, a feed controller 46 connected with the pipe in the other end and feeding the solution while discharging a part of it during feeding, and a drain pipe 42 for discharging the solution fed and used in the pipe 4, the leading end of feed pipe 41 is in communication through the main body 3 with the pipe 4 to be cleaned and with the feed controller 46, and the trailing end of drain pipe 42 is in communication through the main body 3 with the pipe 4. In FIGS. 8 and 9, numeral 44 is a feed valve, and 45 a cartridge filter. By supplying a solution into the pipe 4 by means of the wetting means 40, deposits adhered to the inside wall of pipe 4 are loosened, and the cleaning is facilitated. In this case, the cleaning solution is preferably bubbled by aerodynamic force of the air source.

Incidentally, the solution fed to the feed pipe 41 is not limited to water of ordinary temperature, but may be warm water.

The pig contracting means 110 is provided to remove water absorbed by the pig 6. For the pig contracting means 110, such structure as shown in FIGS. 10 to 13 may be employed. In other words, the pig contracting means 110 comprises a driving source 112 such as a fluid pressure cylinder provided on a top plate 111 of the box-type pig inserting tube 5, a pressure plate 114 connected with a driving shaft 113 of the driving source 112 and applying pressure to the pig 6 for dewatering, and a duckboard 115 formed with spacings therein so that it can be flexed along the curved surface of pig 6, and the pig 6 is contracted by diving the driving source 112, and vertically moving the pressure plate 114. The contraction of the pig 6 may be achieved automatically as shown in FIGS. 10 to 13 or manually. Numerals 116, 117 show valves.

In the feed controller 46 shown in FIGS. 8 and 9, an overflow pipe 463 is uprightly provided slightly above a bottom plate 462 that forms a housing 461, a slit 464 is formed between the lower end of overflow pipe 463 and the upper surface of bottom plate 462, and flow rate from the pipe 4 is higher than discharge rate of the slit 464, thus, when overflow exceeding the upper end of overflow pipe 453 occurs in the housing 461, the solution is discharged from the upper part to the lower part in the overflow pipe 463. Initial supply water containing heavy dirt in the pipe 4 that is cleaned by the wetting means is discharged, at the beginning of operation, from the drain pipe 42 through an outlet 465 and discharge pipe 466. The discharge operation can be automatically performed by combining a level sensor 47, timer and the like.

Operation of the embodiment 2 is described below by referring to FIGS. 8 to 14.

1. The devices are set to the main body 3 of cleaning apparatus, the pig contracting means 110, that is, the pressure plate 114 provided in the pig station (pig inserting tube 5) is lowered so that the pig 6 is contracted.

2. Then, the cleaning solution is supplied into the pipe 4 from the solution supply source 48 and feed pipe 41 which are the wetting means 40, and discharged from the drain pipe 42 that is the wetting means 40, thus, the inside of pipe 4 is rendered wet or provided with a wet surface. In this operation, initial supply water containing heavy dirt is discharged from the feed controller 46 while the solution is fed, and this can be achieved automatically by combining a level sensor, timer and the like.

Figure 10:
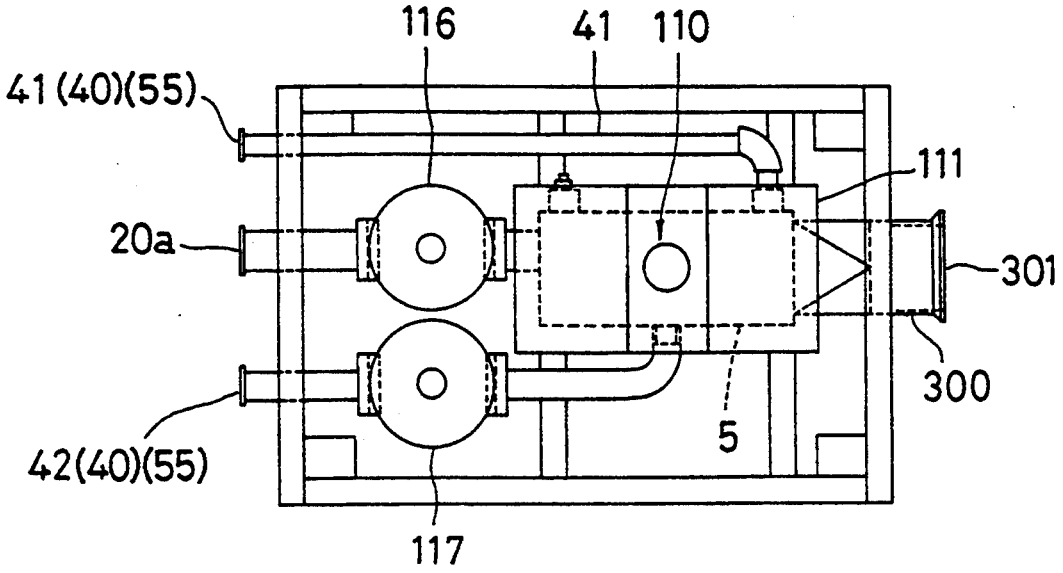
FIG. 10 is a plan view showing the vicinity of pig contracting means.
Figure 11:
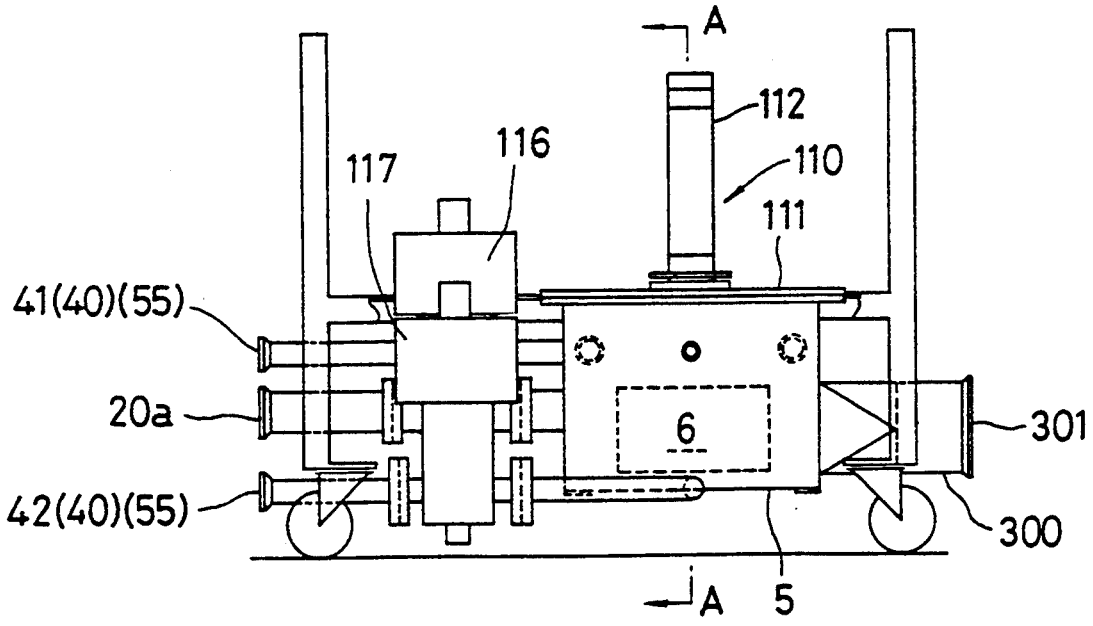
FIG. 11 is a front view of FIG. 10.
Figure 12:
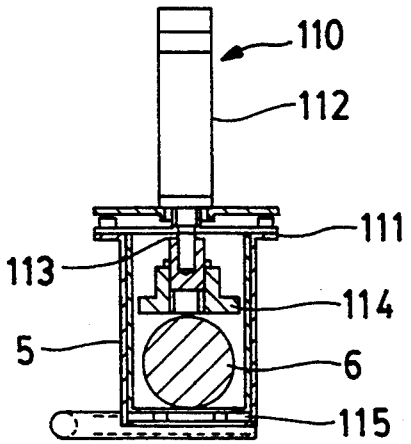
FIG. 12 is a sectional view along line A—A of FIG. 11.
Figure 13:
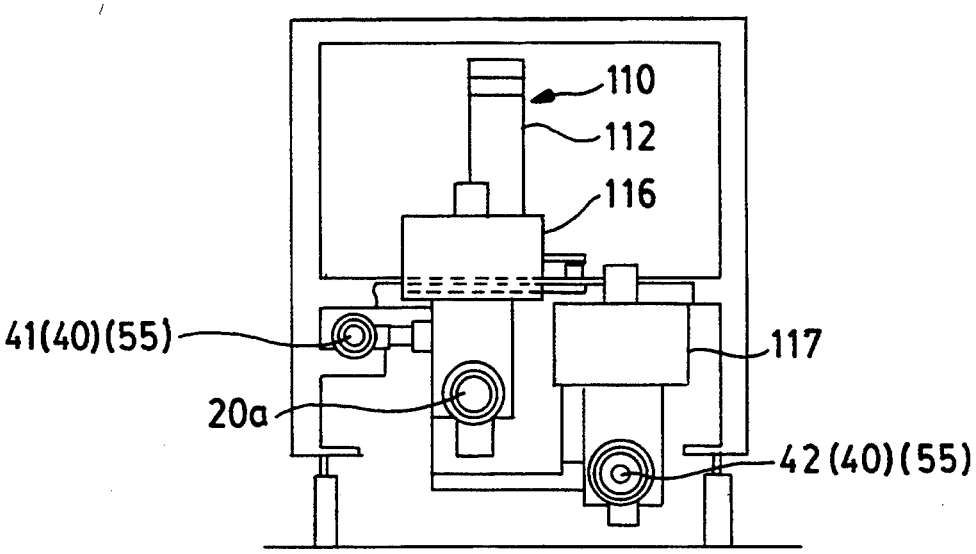
FIG. 13 is a left side view of FIG. 11.

As shown in FIGS. 10 and 11, the pig 6 is inserted in the pig inserting pipe 5 through the opening 301 of the connecting pipe 300 to which a pipe 4 to be cleaned is connected. Then the pig 6 is forced into the pipe 4 from the pipe 5 under aerial pressure introduced through the air inlet and outlet 32. The pig 6 is then caused to vibrate under air vibration provided by the vibration generating source 2, and to advance or retreat under aerial pressure from the pipe 32, in the course of which it cleans the inside of the pipe 4.

The operation of vibration generating source 2 at this stage is as described in association with the embodiment 1. In other words, upon actuation of the air source 10, the directional control valve 17 initiates continuous rotation, and when the valve member 22 of the directional control valve 17 is in an inclined state as shown in a solid line in FIG. 8, for example, the air discharged from the air source 10 is supplied, as shown by an arrow, from the discharge pipe 18 through the port 49, valve chest 25 and conduit **20*b*, and from the conduit 20 through the main body 3 of cleaning apparatus into the pipe 4 to be cleaned, so that the pig 6 is subjected to aerial vibration shown in section a of the curve $\alpha$ in FIG. 6, for example, and advanced in the forward direction. When the positioning of valve member 22 is changed from the state of FIG. 8 to that of FIG. 9, in order to suck the air in the conduits 20, 20*b* to the side of intake pipe 19 of air source 10, the pig 6 is subjected to aerial vibration shown in section b of the solid line $\alpha$ in FIG. 6, and advanced in such manner that the central point of amplitude in the reciprocal motion is shifted toward the leading end, while it is repeatedly reciprocated in a state slightly retracted from the first-mentioned position. In this case, it is possible to enable the pig 6 to move forward and backward beyond the range determined by the vibration generating source 2 with the use of the air inlet and outlet pipe 32 through which air is taken in for advancement or withdrawn for retreat. The air take from the conduits 20, 20*b* through ports 52 and 51, intake pipe 19, air source 10, discharge pipe 18 and ports 49 and 50 is discharged through the filter 34** to outside of the system.

As described above, the inside of pipe 4 is cleaned by aerially vibrating and transferring the pig 6 in reciprocal motion, in which the forwarding step of the pig 6 as shown in FIG. 8 and the retracting step thereof as shown in FIG. 9 are alternately repeated. In this operation, the pig 6 rubs the inside wall of pipe 4 with a medium of water while it is transferred. Such cleaning step of the pig 6 (which corresponds to a solution cleaning step) is repeated the number of times desired.

By changing the waveform of aerial vibration by the vibration generating source 2, the stroke length of reciprocal motion of the pig 6 can be changed as desired. The waveform of aerial vibration can be varied according to the invention frequency or frequency, amplitude, and the like. For changing the waveform of aerial vibration, as already described, such method of changing the rotation speed of valve member 22 in the directional control valve 17, mounting angle or angle of rotation of the valve member 22, sectional open area of the ports in valve member 22, and mounting angle of the ports may be appropriately adopted, and an arbitrary waveform can be selected without being limited to the waveform shown in FIG. 6. In such case, the waveform is changed by controlling the inverter 8 by means of the controller 33.

When dewatering of the pig 6 is desired upon completion of each cycle of pigment cleaning step, in the case of returning the pig 6 to the original position in the main body 3 after the setting time is passed, the valve member 22 of directional control valve 17 is rotated and stopped at an attitude shown in FIG. 9 by activating the controller 33, and the airflow within the pipe 4 is, as described above, directed in the rearward direction as indicated by an arrow. Thus, the pig 6 is sucked in the rearward direction of airflow, and returned to the original position in the main body 3 of cleaning apparatus.

In such manner, the pig 6 is returned to the original position, and contracted and dewatered by the pig contracting means 110.

The wetting step for wetting the inside of pipe 4 by means of the wetting means 40, pig inserting step, pig cleaning step and pig contracting step can be set for the time, number, sequence and the like as desired by the controller 33.

After the pig cleaning step, a rinsing step for discharging dusts remaining in the pipe 4 out of the system is added, if required, by using such rinsing means 55 as the wetting means 40 or other supply and discharge apparatus provided separately. In the flow chart of FIG. 14, the rinsing step is added. That is, after completion of the pig cleaning step, water is supplied into the pipe 4 by commonly using the solution supply source 48 and feed pipe 41 that are the wetting means 40, and discharged from the drain pipe 42 to outside the system after the inside of pipe 4 is washed with the water. The rinsing step is repeated the predetermined times. In the rinsing means 55, it is preferred that the cleaning solution supplied is not bubbled by aerodynamic force from the air source.

In addition, in this embodiment, a water droplet removing step for removing water droplets deposited on the inside wall of pipe 4 is added. In other words, after the rinsing step is completed, the pig 6 that is dewatered beforehand is inserted into the pipe 4 in the same manner as in the pig cleaning step, and reciprocally moved in the advancing direction the predetermined times in the pipe 4 by aerial vibration from the vibration generating source 2, so that water droplets adhered to the inner circumferential wall and the like of pipe 4 is absorbed and removed by the pig 6. The pig is returned to the original position in the main body 3, and dewatered, and the water removed therefrom is discharged from the drain pipe 42. Although the water droplet removing means comprises the pig 6 the vibration generating source 2 and the pig contracting means 110, it is not limited in the structure, but may have a modified design as desired. The water droplet removing step can be eliminated when unnecessary.

In the embodiment, for a final step, drying means 60 for drying the inside of pipe 4 is provided. The vibration generating source 2 can be used as the drying means 60 because of the air source 10, the directional control valve 17 and the other accessory components included therein. By such means, the inside wall of pipe 4 can be dried approximately at an ordinary temperature without an exclusive heater. In other words, by this means, the inside of pipe 4 can be dried under the action of aerial vibration provided by the vibration generating source 2 of the vibration generating source 2 (specifically, the air source 10) without using a heater. Specifically, moisture sticking to the inside of the pipe 4 is vaporized and dried by the aerial vibration.

In the case of drying the inside of pipe 4 by commonly using the vibration generating means 2, the valve member 22 of the directional control valve 17 is positioned in upstanding attitude, as shown by dotted broken line 22' in FIG. 8, by the controller 33, and air discharged from the air source 10 is continuously directed, as shown by an arrow, from the discharge pipe 18 through the port 49, valve chest 25 and conduit **20*b*, and from the conduit 20 through the main body 3 into the pipe 4 that is cleaned, thus, through-flow drying the pipe for a predetermined time. Positioning of the valve member 22** is achieved by such positioning means as photoelectric switch and lead switch.

In FIGS. 8 and 9 the reference numerals 35, 36, and 37 designate a valve, a collection filter, and a collection tank, respectively.

The rinsing, water droplet removing and drying steps can be set for the time, sequence and the like as desired.

Figure 14:
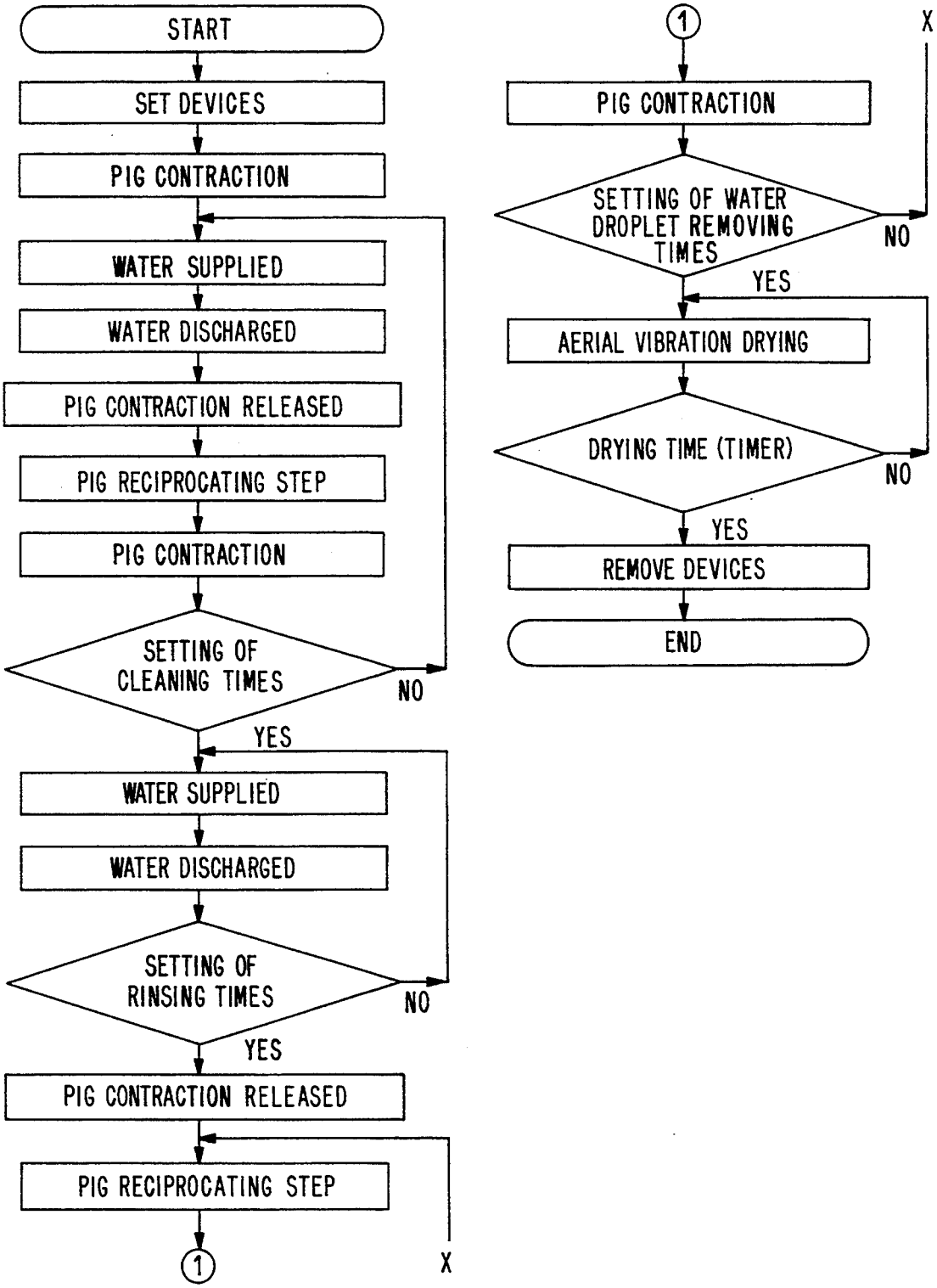
FIG. 14 is a flow chart of embodiment 2.

The steps of FIG. 14 are merely examples of operation of the embodiment, and can be changed as desired.

By using an apparatus of the invention shown in the embodiment 2, methods of the invention as defined in claims 2 to 10 can be conducted.

In other words, as defined in claim 2, the wetting step for wetting the inside of pipe 4 by the wetting means 40, pig inserting step for inserting the pig 6 and the pig cleaning step for cleaning the inside of pipe 4 by transferring the pig 6 while aerially vibrating it in reciprocal motion by the vibration generating means 2 can be performed. In this case, the reciprocal movement of the pig 6, the adjustability of the distance over which the pig moves, and the feasibility of the forward and backward movement of the pig in the conduit have been already described.

A method of the invention according to claim 3 comprising the pig contracting step for dewatering the pig 6, when required, by pig contracting means in addition to the wetting, pig inserting and pig cleaning steps can be conducted. Moreover, as defined in claim 4, a method comprising the solution cleaning step for cleaning the inside of pipe 4 with a cleaning solution by using the wetting means 40, pig inserting step for inserting the pig 6, and pig cleaning step for cleaning the inside of pipe 4 by transferring the pig 6 in reciprocal motion by means of aerial vibration by the vibration generating source 2 can be achieved. A method, as defined in claim 5, comprising the pig contacting step for contracting the pig 6 by the pig contracting means 110 in addition to above steps can be conducted.

Furthermore, methods of the invention including, additionally to the steps, the rinsing step by the rinsing means 55 after completion of the pig cleaning step, as specified in claim 6, and further including the water droplet removing step in addition to these steps after completion of the rinsing step, as described in claim 7, can be performed. The vibration generating source 2, which includes the air source 10, the directional control valve 17 and the other accessory components, can be effectively used as the drying means 60 by taking advantage of the vaporing effect of the aerial vibration provided by the vibration generating source 2.

Figure 15:
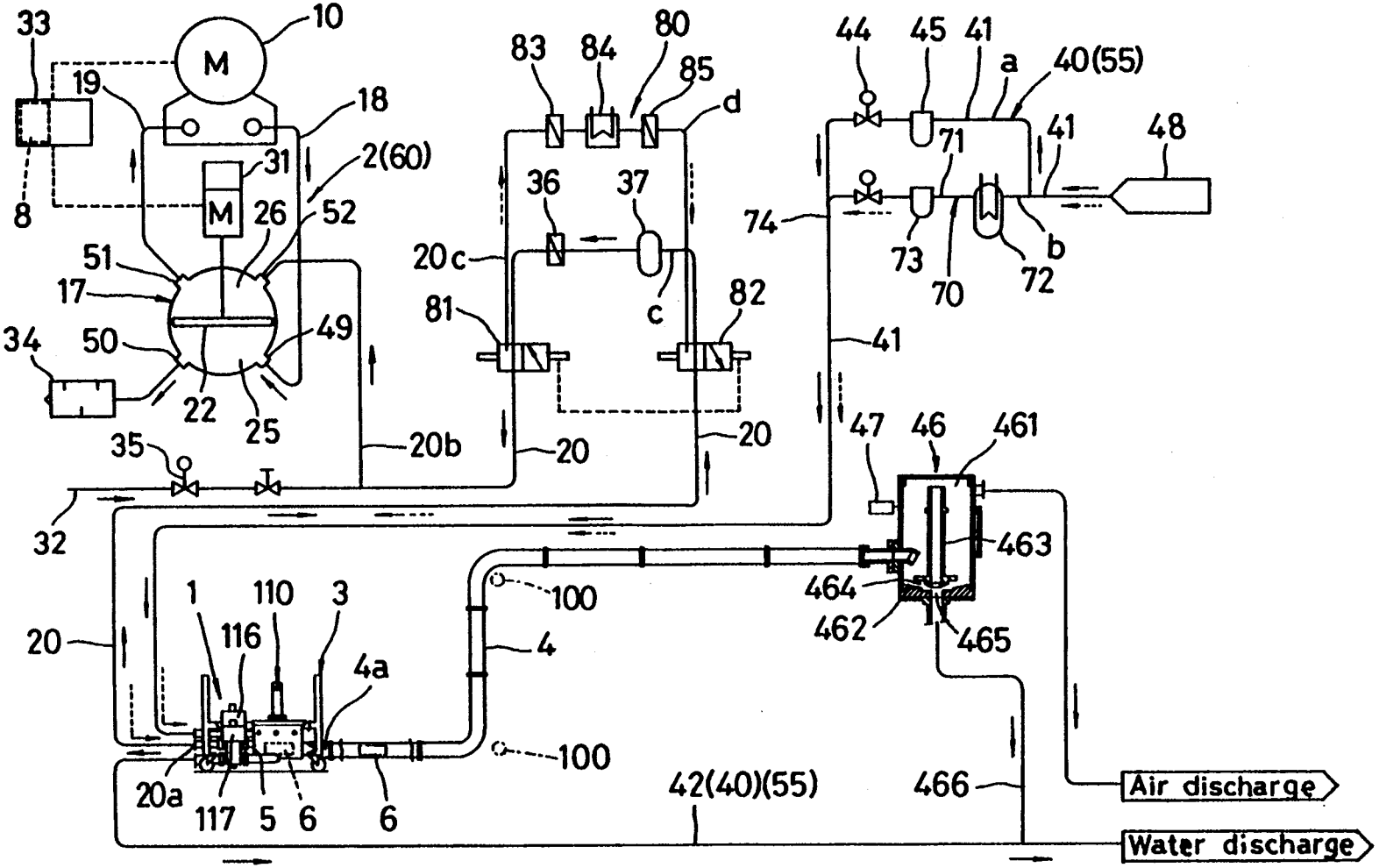
FIG. 15 is a schematic view of embodiment 3 of an apparatus of the invention.

An embodiment 3 of an apparatus of the invention is now described by referring to FIG. 15.

The embodiment is specifically characterized by a fact that warm water supply means 70 and warm air supply means 80 are added to the structure of embodiment 2, while the other parts are structured generally in the same manner as those shown in FIGS. 8 and 9.

In other words, assuming that the feed pipe 41 constituting the wetting means 40 is a line a, in supplying water into the pipe 4, it is supplied from the solution supply source 40 through the line a, a warm water pipe 71 branched from a part of line a and connected in communication with the other part is provided as line b, and a heater 72, filter 73 and warm water valve 74 that constitute the warm water supply means 70 are respectively and sequentially connected to the warm water pipe 71. Therefore, in wetting the inside of pipe 4, water is supplied along the line a as shown in a solid arrow, while warm water is supplied into the pipe 4 by using a line b as shown in a dotted broken arrow and sharing a part of the line a, when warm water is supplied.

A line c is formed by connecting directional control valves 81, 82 such as electromagnetic valve to the conduit 20 on the upstream side of collection filter 36 and downstream side of collection tank 37, and a line d by the conduit **20*c* connected to the directional control valves 81, 82 in both ends thereof, and a filter 83, heater 84 and filter 85 that constitute the warm air supply means 80** are connected to the line d.

Thus, by actuating the directional control valves 81, 82, when the line d is closed and the line c opened, upon actuation of the vibration generating means 2, the aerial vibration is conducted to the inside of conduits 20*b*, 20 and 20*a* including the line c, the pig 6 within the pipe 4 is transferred in reciprocal motion by aerial vibration and cleans the pipe, and the inside of pipe 4 can also be through-flow dried, as described in association with the embodiment 2, by switching the valve member 22 of the vibration generating means 2 as required. Upon actuation of the directional control valves 81, 82, when the line c is closed and line d opened, by turning on the heater 84, the thermal energy can be directed with air from the air source 10 constituting the vibration generating means 2, and the inside of pipe 4 can be hot-air dried as well.

The warm water supply means 70 is not limited to the structure shown in FIG. 15, and the design can be modified, for example, so as to separately provide an independent route from the wetting means 40.

The warm air supply means 80 is not limited to the structure shown in FIG. 15, and an exclusive conduit for the warm air supply means 80, for example, can be used instead of sharing the conduit 20, or an air source separately provided may be employing in the warm air supply means 80 shown in FIG. 15 as a ventilation source instead of using the air source 10 of the vibration generating source 2.

An embodiment 4 of an apparatus of the invention is described below by referring to FIG. 16.

Figure 16:
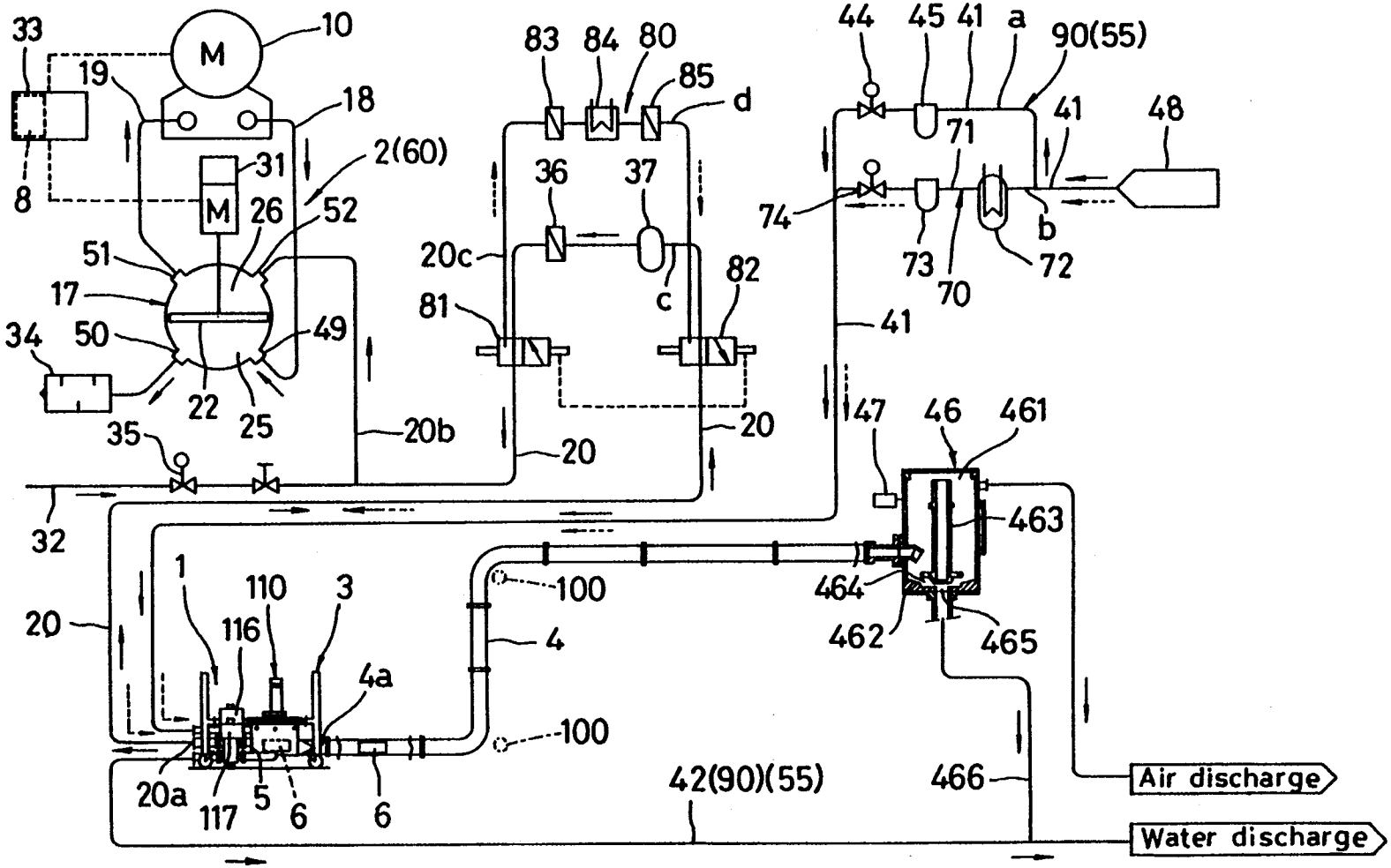
FIG. 16 is a schematic view of embodiment 4 of an apparatus of the invention.

In the embodiment 4, as shown in FIG. 16, the wetting means 40 of FIG. 15 is substantially by solution cleaning means 90, in the figure, the solution supply source 48, feed pipe 41, cartridge filter 45, water supply valve 44 and drain pipe 42 are also used as the solution cleaning means 90, the inside of pipe 4 is cleaned with a solution by the solution cleaning means 40, and the embodiment comprises at least the pig 6 removably inserted from an end side of the pipe 4 and vibration generating means 2 for transferring the pig 6 in reciprocal motion by aerial vibration to clean the inside of pipe 4. Initial supply water containing heavy dirt in the pipe 4 that is cleaned by the solution cleaning means 90 is discharged at the beginning of operation from the drain pipe 42 through the outlet 46 and discharge pipe 466 of the feed controller 46. The discharge operation can be automatically performed by combining a level sensor 47, timer and the like.

In FIG. 16, in addition to the above, the pig contracting means 110 shown in FIGS. 10 to 13, rinsing means 55, water drop removing means, warm water supply means 70 and warm air supply means 80, or drying means 60 comprising through-flow drying means or the like are provided.

By using the apparatus of embodiment 4, methods of the invention according to claims 4 to 10 can be performed. It means that the solution cleaning, pig inserting, pig cleaning, pig contracting, rinsing, water droplets removing and drying steps can be combined as desired.

Figure 17:
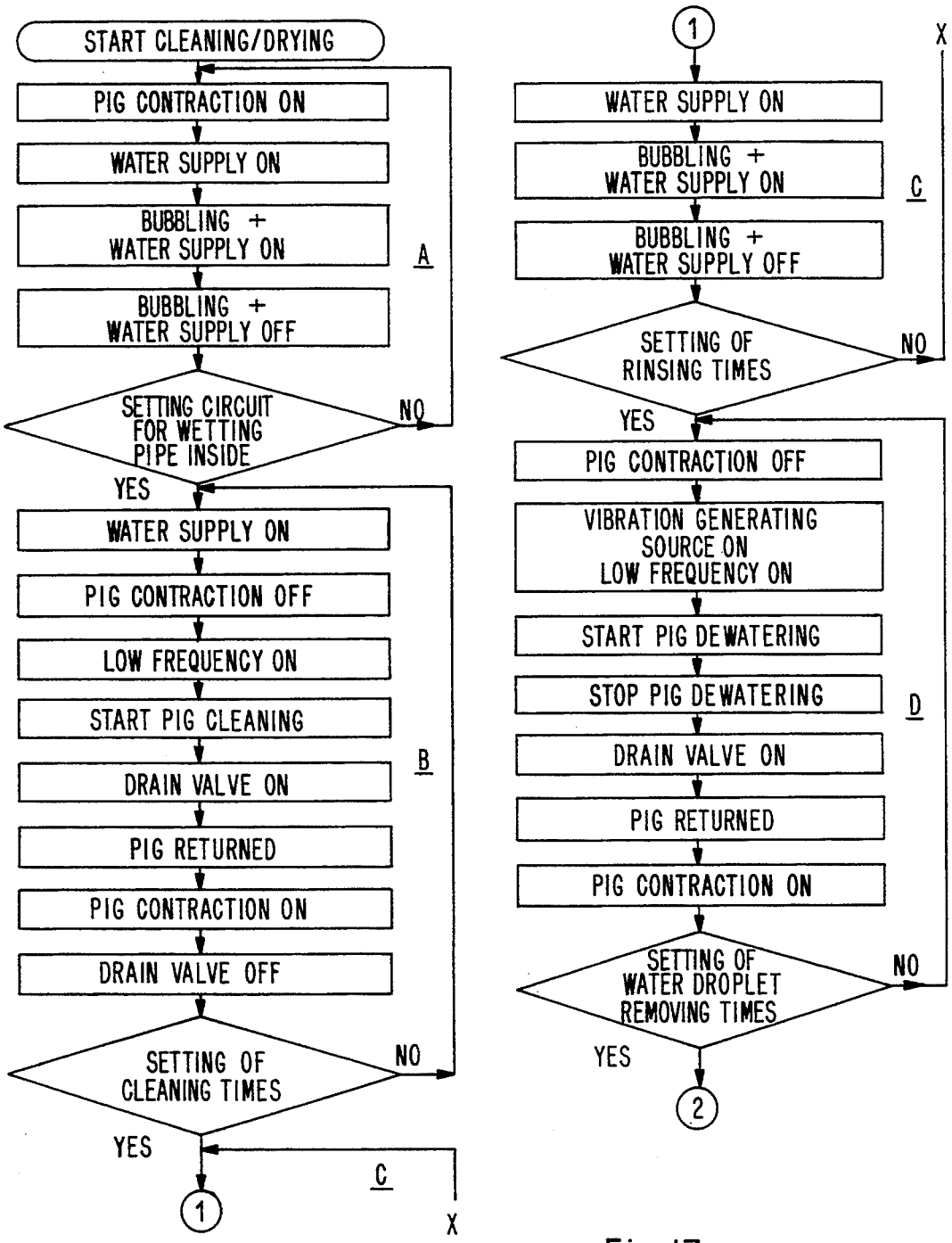
FIG. 17 is a part of another flow chart of a method of the invention.
Figure 18:
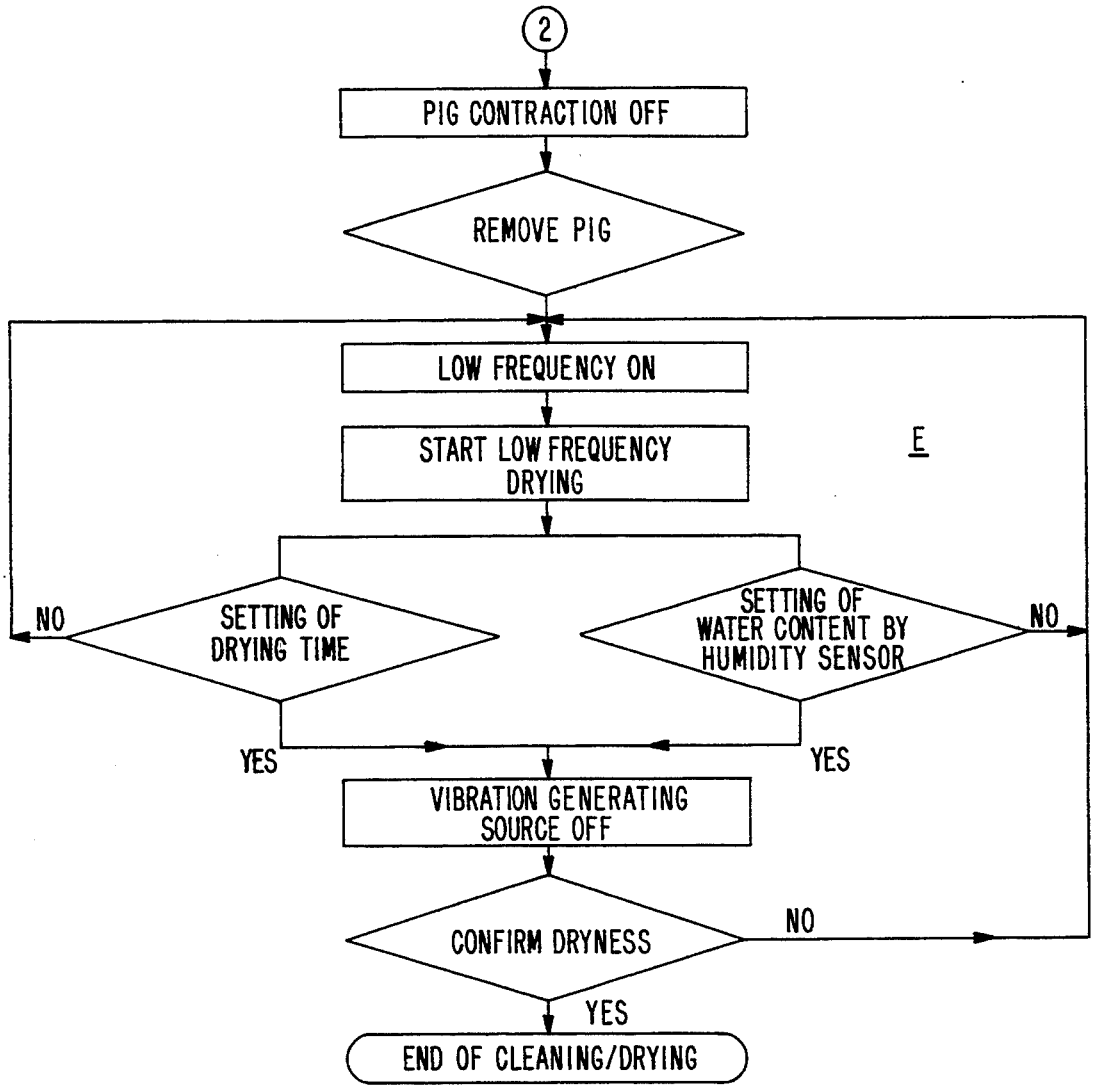
FIG. 18 is the rest of another flow chart of the method of the invention.

FIG. 17 shows a part of another preferred process of a method of the invention, FIG. 18 the remaining part thereof. In association with a cleaning apparatus structured as shown in FIGS. 8 to 13, the process of the figures is described below.

The operation for cleaning the inside of a pipe is generally common with the example of process of FIG. 14. In other words, it comprises a wetting step (also referred to as humidifying step), pig cleaning step using a pig and cleaning water, rinsing step, water droplet removing step and drying step. However, those shown in FIGS. 17 and 18 are significantly different from that of FIG. 14 by the fact that the cleaning water is bubbled in the wetting and rinsing steps, and that in the drying process, where moisture is dried under the vaporing effect of the aerial vibration provided by the vibration generating source 2.

In other words, firstly, the pig 6 in the main body 3 of cleaning apparatus is contracted by the pig contracting 110. Succeedingly, the feed valve 116 is opened, discharge valve 117 is closed, water is supplied from the solution supply source 48 into the pipe 4 by the wetting means 40, and the wetting step A is started. Simultaneously with the water supply, the supply solution is bubbled by aerodynamic force from the air source 10 for loosening deposits adhered to the inside wall of pipe 4, and discharged. Such operation is performed the predetermined number of times.

After completion of the wetting step A, a cleaning solution is supplied into the pipe 4, and the pig cleaning step B (solution cleaning step) wherein the inside of pipe 4 is cleaned by transferring the pig 6 in reciprocal motion by aerial vibration (at low frequency) is conducted. After the pig cleaning is completed, the pig 6 is returned to the original position and dewatered. Waste water produced during the operation is discharged from the drain pipe 42. Such pig cleaning step B is repeated the predetermined number of times.

Succeedingly, the rinsing step C for supplying a cleaning solution into the pipe 4 and rinsing the inside thereof is performed. In this case, similarly to the wetting step A, the cleaning solution supplied is bubbled by aerodynamic force from the air source 10. Such operation is performed the predetermined number of times.

After the rinsing step C, a water droplet removing step D is performed for removing water droplets adhered to the inside wall of pipe 4. In the water droplet removing step D and the succeeding drying step E, the vibration generating source 2 is activated, and a low frequency wave is provided. In the water droplet removing step D, the pig 6 absorbs water droplets therein, while being reciprocally moved by the low frequency wave. The pig 6 with water absorbed therein is returned to the original position, then, dewatered.

In the drying step E, by utilizing the vaporizing effect of aerial vibration (at low frequency) provided by the vibration generating source 2 while the same aerial vibration is used to enable the pig 6 to move to and fro in and along the pipe 4, the inside of pipe 4 is dried without using any heater. The drying operation is performed until a set water content of a humidity sensor and set drying time are reached, when the set water content and set drying time are reached, the vibration generating means 2 is turned off, and the cleaning and drying are completed in the case that a target value is reached after confirming the dryness.

In the embodiments, as shown in FIGS. 1, 8, 9, 15 and 16, a position sensor 100 is provided corresponding to points in the pipe 4 (such as bends) where dirts tend to be accumulated, so that such variables as the number of reciprocal movements of the pig 6 and waveform of the aerial vibration can be adjusted in the vicinity of the position sensor 100. More specifically, the wavelength of aerial vibration waves is adjusted by changing the rotation (r.p.m.) of the valve 22 in the directional control valve 17 through the motor whose frequency is changed by varying the inverter 8 in response to signals generated by the position sensor 100 and received by the controllers 7 and 33. Alternatively, the waveforms of aerial vibration can be adjusted by introducing or withdrawing air through an air inlet-and-outlet 9 provided in the conduit 20. In such manner, the points in the pipe 4 where dirts tend to be accumulated can be intensely cleaned.

Figure 19:
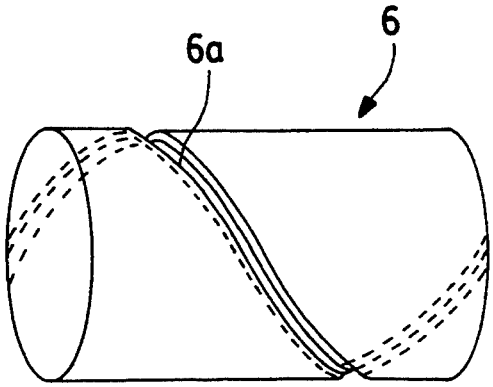
FIG. 19 is a perspective view of a modified example of pig.

For the pig 6, a columnar sponge is used in the embodiment, the shape is selected as desired. For example, as shown in FIG. 19, it is preferably that one or more spiral slit grooves 6*a* are formed in the outer surface in the longitudinal direction of a columnar body with an appropriate length, and the pig 6 is rotated and transferred by passing air from the air source 10 through the slit grooves 6*a*.

If the pipe used in the air conveying apparatus, drying device or dehumidifier is long, generally plural short pipes are coupled by known means such as flange joint. Hence, when cleaning the inside of the conduit of such short pipes, as mentioned above, it required complicated work of disassembling the plural short pipes, cleaning with brush, drying, and reassembling. If water drops often remained in the joints of the short pipes to lower the quality of the product such as powder material pneumatically conveyed in the duct.

Figure 20:
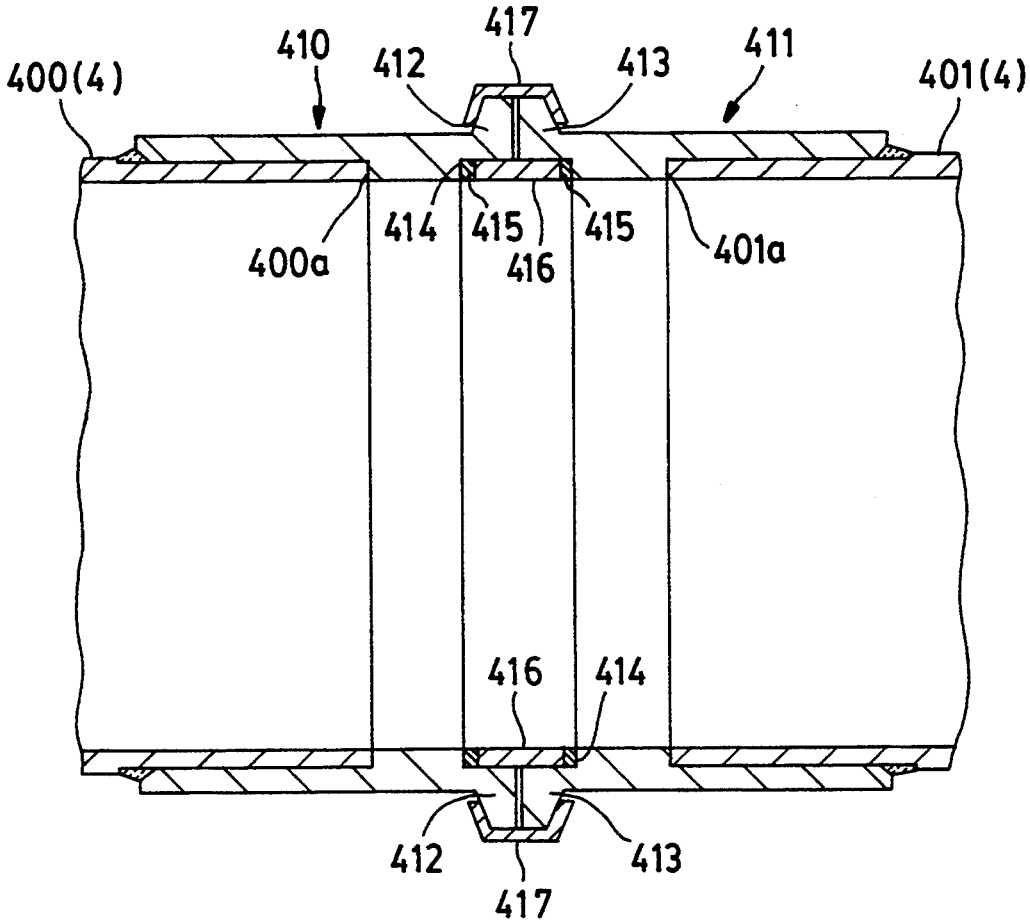
FIG. 20 is a sectional view of a pipe joint.

To solve such problem, the pipe of the invention has special means. That is, explaining by reference to FIG. 20, the pipe 4 is combining by connecting two or more short pipes 400, 401, . . . , and the end parts 400*a*, 401*a* of the adjacent short pipes 400, 401 , . . . are connected with a pair of tubular joints 410, 411 having a same inner wall surface as the inner wall surface of the same short pipes 400, 401. On the other hand, at the connection ends of the pair of tubular joints 410, 411, outward flanges 412, 413 are formed, and at the inner wall sides of the joints 410, 411 confronting the flanges 412, 413, a sleeve insertion groove 414 is formed, and a sleeve 416 having an O-ring 415 and possessing a greater stiffness than the short pipes 400, 401, . . . is inserted in the sleeve insertion groove 414. A clamp band 417 is held and tightened by the outward flanges 412, 413.

By composing the pipe 4 in such manner, when the outward flanges 412, 413 of the tubular joints 410, 411 is tightened by the clamp band 417, since the connection end part of the joints 410, 411 is supported from inside of the duct by the sleeve 416, distortion is not caused in the connection end part. Accordingly, together with the presence of the O-ring 415, the water sealing effect of the joint part is excellent. If the O-ring 415 should deteriorate, or if there is water leak between the sleeve 416 and the tubular joints 410, 411, since the pig 6 is moving reciprocally in the duct of the pipe 4, air vibratory waves of pulsating waves are generated, and the air vibratory waves suck the remaining leak water into the duct. As a result, the seam of the duct is dried by aerial vibration waves, and the quality of the material conveyed in the duct is not lowered.

Although a force feed system such as blower is used, in the apparatus of the invention, for the air source 10 of vibration generating source 2 attached to the trailing end of the pipe 4 to be cleaned, as shown in the embodiment, such suction system as vacuum pump may be used for the air source 10 attached to the leading end of pipe 4 in the apparatus of the invention.

In a method of the invention, as already described, a dry method (claim 1), wet method (claim 2) and solution cleaning method (claim 4) may be independently employed, respectively, or these three method may be performed in an appropriate combination.

In addition, the pig contracting, rinsing, water droplet removing and drying steps (claims 3 and 5 to 8) can be performed in an appropriate combination with above methods. Sequence of the steps can be appropriately combined without being limited in FIGS. 7, 14, 18 and 19, and performed.

In an apparatus of the invention, as described above, on the basis of the pig 6 and vibration generating source 2, the wetting means 40, pig contracting means 110, solution cleaning means 90, rinsing means, water droplet removing means and drying means 60 can be appropriately combined. Then, these means are adapted to automatically clean the inside of pipe 4.

It is an advantage that the installation space can be saved by housing or attaching the pig 6, vibration generating means 2, wetting means 40, pig contracting means 110, solution cleaning means 90, rinsing means 55, water droplet removing means and drying means 60 comprising the apparatus of the invention in a box-like member (main body 3 of cleaning apparatus).

Meanwhile, the invention may be applied also for the purpose of drying only. In such a case, if it is intended to dry the water drops on the inner wall of the pipe, most water drops are absorbed on the pig, while water drops are divided into small particles to be dried easily, and then the pig is removed from the pipe, allowing the aerial vibration to reach easily the end or seam of the pipe, so that an effective drying is achieve. Therefore, the pig is not necessary if it is intended to remove moisture in the pipe or remove water content contained in the seam.

In FIGS. 1, 8, 9, 15, and 16, an air lead-in pipe 9, 32 is provided in the vibration source 2 as air inlet and outlet, and the pig 6 moving reciprocally in the pipe 4 to be cleaned is transferred freely in the upstream direction or downstream direction by injection or suction of air from the air inlet and outlet, so that the pig 6 is transferred while moving reciprocally.

We claim:

1. An apparatus for cleaning an inside of a pipe, the apparatus comprising a pig removably inserted in the pipe and a vibration generating source for moving the pig to and fro under aerial vibration whereby the inside of the pipe is cleaned.

2. The apparatus according to claim 1, wherein air inlet and outlet are provided in the vibration generating source, the pig is caused to move in an upstream direction and downstream direction in and along the pipe by injection or suction of air from the air inlet and outlet.

3. The apparatus according to claim 1 or 2, further comprising a wetting means for wetting the inside of pipe.

4. The apparatus according to claim 3, wherein the wetting means comprises a liquid feed source, a liquid feed pipe connected with the liquid feed source, a feed water controller for feeding water while partly discharging water in the midst of and a liquid discharge pipe for feeding water into the pipe and discharging after use, and the front end side of the liquid feed pipe communicates with the pipe to be cleaned and the feed water controller through the cleaning apparatus main body, and the base end of the liquid discharge pipe communicates with the pipe through the cleaning apparatus main body.

5. The apparatus according to claim 3, further comprising a drying means for dewatering the inner wall of the pipe.

6. The apparatus according to claim 5, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

7. The apparatus according to claim 3, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

8. The apparatus according to claim 3, wherein the pipe comprises two or more short pipes connected one after another by means of tubular joint units, the tubular joint units being used in pair so as to couple adjacent short pipes together, each of the joint units comprising a first portion of the same inside diameter as that of the short pipe, including a ring-shaped groove and an outward flange, a ring-shaped sleeve, a clamp band placeable on the outward flange, and a second portion having a larger inside diameter than that of the first portion, the first portion and the second portion being bordered by a ring-shaped shoulder so that the short pipe is received in the second portion with the end of it being bordered by a shoulder, the sleeve being fitted in the grooves of the adjacent joint units in the air- and liquid-tight manner, and the adjacent joint units being connected to each other by means of the clamp band.

9. The apparatus according to claim 1 or 2, further comprising a solution cleaning means for cleaning the inside of pipe with a cleaning solution.

10. The apparatus according to claim 9, wherein the solution cleaning means is also used as a wetting means comprising a liquid feed source, a liquid feed pipe connected with the liquid feed source, a feed water controller for feeding water while partly discharging water to the midst of feeding water as being connected to the other end of the pipe, and a liquid discharge pipe for feeding water into the pipe and discharging after use.

11. The apparatus according to claim 10, further comprising a drying means for dewatering the inner wall of the pipe.

12. The apparatus according to claim 16, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

13. The apparatus according to claim 1 or 2, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

14. The apparatus according to claim 1 to 2, wherein the pipe comprises two or more short pipes connected one after another by means of tubular joint units, the tubular joint units being used in pair so as to couple adjacent short pipes together, each of the joint units comprising a first portion of the same inside diameter as that of the short pipe, including a ring-shaped groove and an outward flange, a ring-shaped sleeve, a clamp band placeable on the outward flange, and a second portion having a larger inside diameter than that of the first portion, the first portion and the second portion being bordered by a ring-shaped shoulder so that the short pipe is received in the second portion with the end of it being kept in abutment with the shoulder, the sleeve being fitted in the grooves of the adjacent joint units in an air- and liquid-tight manner, and the adjacent joint units being connected to each other by means of the clamp band.

15. An apparatus for cleaning an inside of a pipe, the apparatus comprising a pig removably inserted in the pipe, an air vibration generating for moving the pig to and fro in and along the pipe under aerial vibration, an air inlet-and-outlet for causing the pig to move freely upstream and downstream under a supply and withdrawal of air, and a wetting means for wetting the inside of the pipe, and a pig contracting means for contracting the pig.

16. The apparatus according to claim 15, further comprising a solution cleaning means for removing any solution form the inside of the pipe.

17. The apparatus according to claim 15 or 16, wherein the pig contracting means comprises a driving source provided on a top plate of a box-shaped pig insertion pipe, a pressure plate for dewatering the pig as being coupled with a drive shaft of the driving source, and a duckboard formed like a duckboard so as to deflect along the curvature of the pig, and the pig is contracted by moving up and down the pressure plate by driving the driving source.

18. The apparatus according to claim 17, further comprising a rinsing means for rinsing the inside of the pipe.

19. The apparatus according to claim 18, wherein the rinsing means is used as the wetting means comprising a liquid feed source, a liquid feed pipe connected with the liquid feed source, a feed water controller for feeding water while partly discharging water in the midst of feeding water as being connected to the other end of the pipe, and a liquid discharge pipe for feeding water into the pipe and discharging after use.

20. The apparatus according to claim 18, further comprising a water droplet removing means.

21. The apparatus according to claim 20, wherein the water droplet removing means is also used as a pig, a vibration generating source, and a pig contracting means, the dewatered pig is inserted into the pipe, and is moved to and fro in the pipe by aerial vibration provided by the vibration generating source so as to enable the dewatered pig to absorb the water drops adhered on the inner peripheral wall of the pipe, and the moistened pig is dewatered by the pig contracting means, and the dewatered water is discharged through the liquid discharge pipe.

22. The apparatus according to claim 20, further comprising a drying means for dewatering the inner wall of the pipe.

23. The apparatus according to claim 20, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

24. The apparatus according to claim 20, wherein the pipe comprises two or more short pipes connected on after another by means of tubular joint units, the tubular joint units being used in pair so as to couple adjacent short pipes together, each of the joint units comprising a first position of the same inside diameter as that of the short pipe, including a ring-shaped groove and an outward flange, a ring-shaped sleeve, a clamp band placeable on the outward flange, and a second portion having a larger inside diameter than that of the first portion, the first portion and the second portion being bordered by a ring-shaped shoulder so that the short pipe is received in the second portion with the end of it being kept in abutment with the shoulder, the sleeve being fitted in the grooves of the adjacent joint units in an air- and liquid-tight manner, and the adjacent joint units being connected to each other by means of the clamp band.

25. The apparatus according to claim 18, further comprising a drying means for dewatering an inner wall of the pipe.

26. The apparatus according to claim 18, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

27. The apparatus according to claim 15 or 16, comprising a water droplet removing means.

28. The apparatus according to claim 27, wherein the water droplet removing means is also used as a pig, a vibration generating source, and a pig contracting means, the dewatered pig is inserted into the pipe, and is moved to and fro in the pipe by aerial vibration provided by the vibration generating source so as to enable the dewatered pig to absorb the water drops adhered on the inner peripheral wall of the pipe, and the moistened pig is dewatered by the pig contracting means, and the dewatered water is discharged through the liquid discharge pipe.

29. The apparatus according to claim 27, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

30. The apparatus according to claim 15 or 16, further comprising a drying means for dewatering an inner wall of the pipe.

31. The apparatus according to claim 15 or 16, further comprising a position sensor located in a place liable to become stained in the pipe, a controller for receiving signals from the position sensor, the controller adjusting the frequency of the reciprocal movement of the pig and the waveform of aerial vibration in response to the received signals near the position sensor.

32. The apparatus according to claim 15 or 16, wherein the pipe comprises two or more short pipes connected on after another by means of tubular joint units, the tubular joint units being used in pair so as to couple adjacent short pipes together, each of the joint units comprising a first portion of the same inside diameter as that of the short pipe, including a ring-shaped band placeable on the outward flange, and a second portion having a larger inside diameter than that of the first portion, the first portion and the second portion being bordered by a ring-shaped shoulder so that the short pipe is received in the second portion with the end of it being kept in abutment with the shoulder, the sleeve being fitted in the grooves of the adjacent joint units in an air- and liquid-tight manner, and the adjacent joint units being connected to each other by means of the clamp band.

* * * * *

UNITED STATES PATENT AND TRADEMARK OFFICE

CERTIFICATE OF CORRECTION

PATENT NO. : 5,442,826
DATED : August 22, 1995
INVENTOR(S) : Kazue Murata, et al.

It is certified that error appears in the above-indentified patent and that said Letters Patent is hereby corrected as shown below:

Title page,
Item [30] Foreign Application Priority Data:

Add --July 5, 1993 [JP] Japan ..... 5-220398--

Signed and Sealed this

Nineteenth Day of November, 1996

*Attest:*

Bruce Lehman

BRUCE LEHMAN

*Attesting Officer*

*Commissioner of Patents and Trademarks*